US007104619B2

(12) United States Patent
Ludwig et al.

(10) Patent No.: US 7,104,619 B2
(45) **Date of Patent: *Sep. 12, 2006**

(54) ANTI-TIP INTERLOCKING LINKAGE MECHANISM FOR VERTICAL CABINETS

(75) Inventors: Gary R. Ludwig, Holland, MI (US); Jamie L. Payne, Grand Rapids, MI (US); Todd T. Andres, Sparta, MI (US); Robert Dalton, Mauldin, SC (US); Glyn A. Finch, Jr., Simpsonville, SC (US)

(73) Assignee: CompX International Inc., Mauldin, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/107,072

(22) Filed: Apr. 15, 2005

(65) Prior Publication Data

US 2005/0179346 A1 Aug. 18, 2005

Related U.S. Application Data

(63) Continuation of application No. 10/224,832, filed on Aug. 21, 2002, now Pat. No. 6,969,129.

(51) Int. Cl.
*E05B 53/00* (2006.01)

(52) U.S. Cl. ..... 312/221; 312/217

(58) Field of Classification Search ..... 312/216, 312/217, 218, 221, 222, 215
See application file for complete search history.

(56) References Cited

U.S. PATENT DOCUMENTS

| | | | | |
|---|---|---|---|---|
| 2,886,392 | A * | 5/1959 | Stegmaier | 312/217 |
| 4,662,689 | A * | 5/1987 | Chatterson et al. | 312/219 |
| 4,768,844 | A * | 9/1988 | Ludwig | 312/221 |
| 4,865,404 | A * | 9/1989 | Harper | 312/221 |
| 4,925,258 | A * | 5/1990 | Ludwig et al. | 312/323 |
| 4,966,423 | A * | 10/1990 | Higuera et al. | 312/221 |
| 5,352,030 | A * | 10/1994 | Derle et al. | 312/221 |
| 6,238,024 | B1 * | 5/2001 | Sawatzky | 312/221 |
| 6,932,445 | B1 * | 8/2005 | Chiu | 312/221 |

FOREIGN PATENT DOCUMENTS

JP 9234129 * 9/1997

* cited by examiner

*Primary Examiner*—Janet M. Wilkens
(74) *Attorney, Agent, or Firm*—Banner & Witcoff, Ltd.

(57) ABSTRACT

An anti-tip linkage mechanism for vertical file cabinets of the type having drawers and/or pivotal front panels includes molded polymeric cam follower housings that snap-fit onto each of the slide channels for the drawers or panels and non-circular connecting rods attached to cam actuators that enable interaction of the anti-tip mechanisms incorporated with each slide channel. Lock actuated auxiliary cam mechanisms and panel locking assemblies controllable by a single cabinet lock are connected with a cabinet lock by linkage bars or cables.

3 Claims, 19 Drawing Sheets

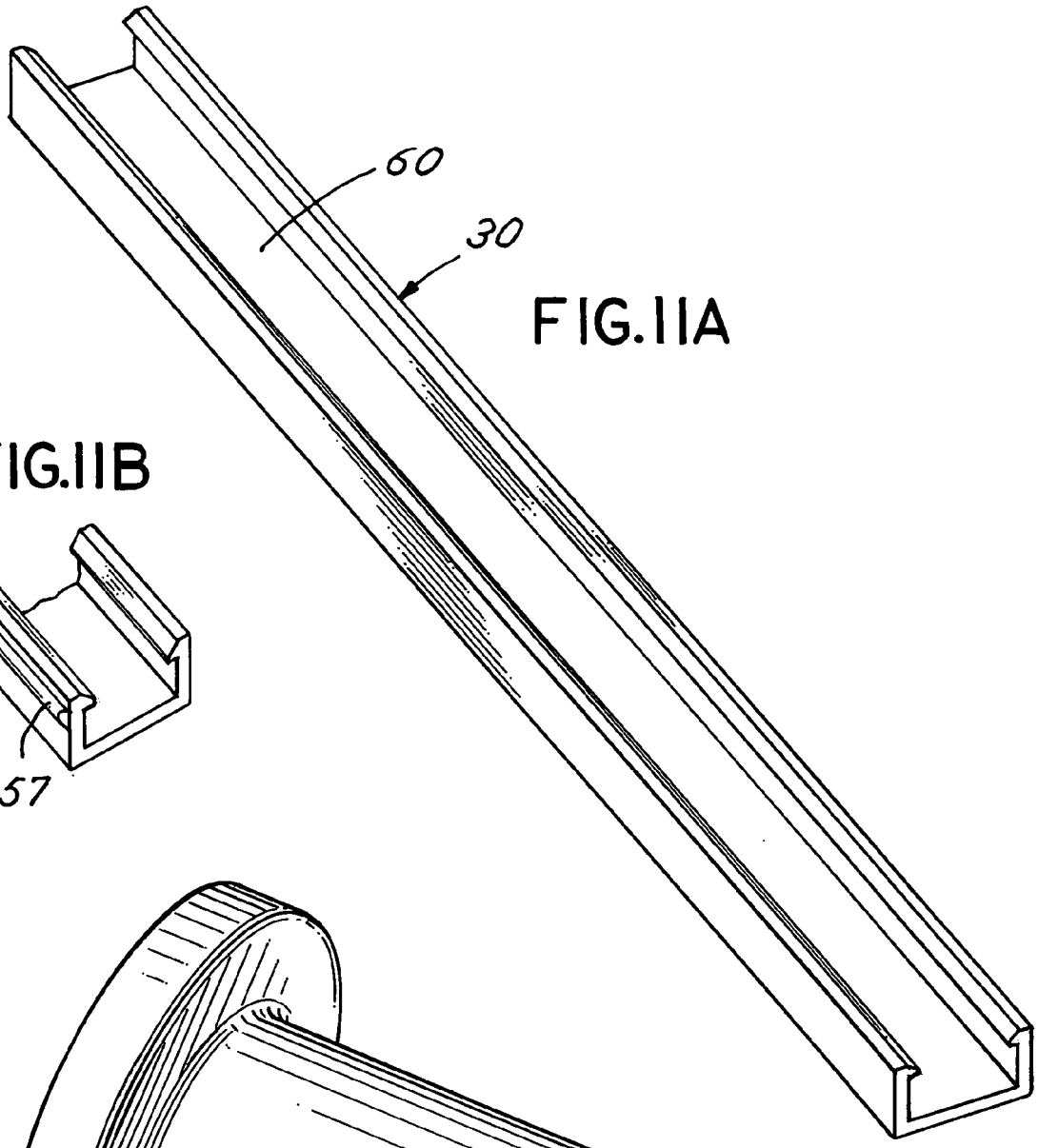
FIG.11A
FIG.11B
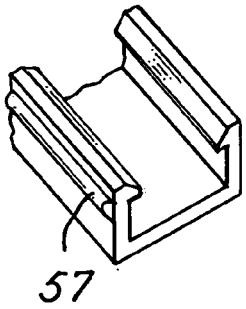
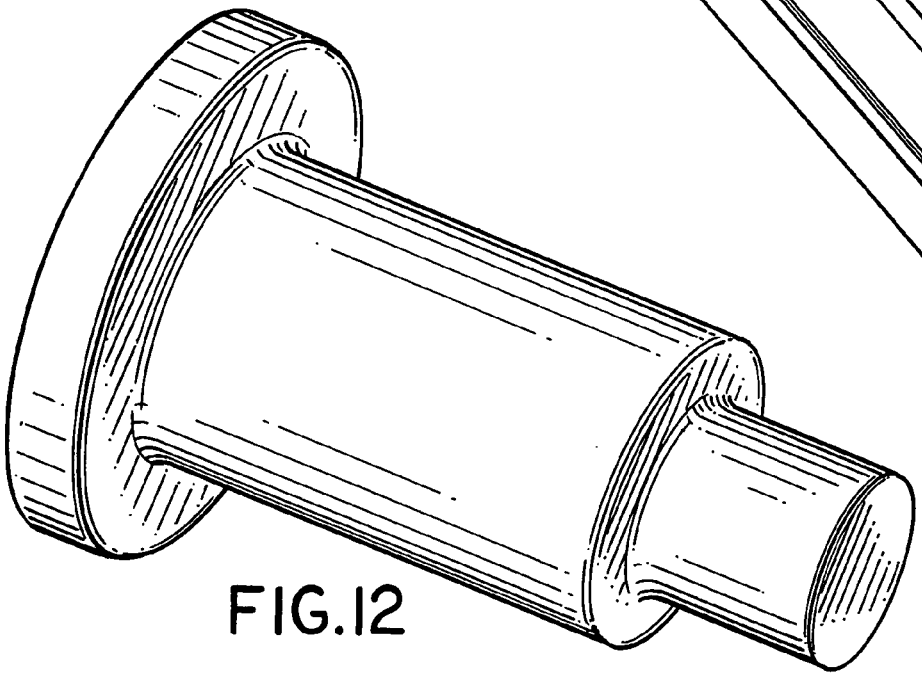
FIG.12

ANTI-TIP INTERLOCKING LINKAGE MECHANISM FOR VERTICAL CABINETS

CROSS REFERENCE TO RELATED APPLICATION

This is a continuation application of application Ser. No. 10/224,832 now U.S. Pat. No. 6,969,129 filed Aug. 21, 2002 entitled: Anti-Tip Interlocking Linkage Mechanism for Vertical Cabinets" for which priority is claimed.

BACKGROUND OF THE INVENTION

In the principal aspect the present invention relates to a mechanism for interlocking a series of vertical drawers in a filing cabinet or the like. More particularly, the invention relates to the construction of the component parts associated with a locking and anti-tip linkage mechanism in a cabinet of the type having drawers, slidable panels, and the like arrayed vertically. In addition, the invention relates to such mechanisms having a cable or linkage bar actuated locking mechanism.

Vertical filing cabinets may have two or more drawers and/or pivotal front panels or sliding panels mounted vertically one above the other. When one of the drawers or panels is open to its fullest extent for access to the contents of the cabinet, the center of gravity of the cabinet may be offset. A problem that can result from such an offset is a tendency of the filing cabinet to tip thereby possibly causing an injury or damage. Thus cabinet manufacturers have installed various devices, known as anti-tip interlock mechanisms, for multiple drawer and multiple panel cabinets to prevent the opening of more than a single drawer and thus to prevent unbalance of the cabinet and tilting thereof. Such anti-tip interlock mechanisms, in general, employ a linkage arrangement associated with the telescoping slides for the drawers, etc. whereby the opening of a single drawer or panel will activate the anti-tip interlocking mechanism causing it to preclude the opening of additional drawers or panels. Consequently, when a single drawer is opened, the remainder of the drawers or panels are locked or retained in the closed position and cannot be opened until the open drawer is returned to its closed position. A typical mechanism of this type is depicted in U.S. Pat. No. 5,352,030 entitled "Anti-Tip Device" and issued to Wolfgang Derle and Ronald G. Schenk on Oct. 4, 1994, which is incorporated herewith by reference. Another patent which discloses an anti-tip interlocking device is U.S. Pat. No. 6,238,024 B1 in the name of Kenneth Sawatzky entitled "Linkage Member for an Anti-Tip/Interlock Device" issued May 29, 2001 also incorporated herewith by reference.

Such prior art mechanisms are highly effective for their intended purpose, to maintain the unopened drawers or panels in a closed position while at the same time another single drawer or panel, etc. is in the open position. Various challenges with respect to such systems have remained, however, including improvement of the procedure for installation, service and/or repair of such systems. That is, often such systems will require parts especially engineered for a particular model of cabinet. Further, such systems typically do not easily accommodate changes in construction or changes in tolerance associated with the manufacture of filing cabinets. As a result, often repair or replacement or original installation of component parts of an anti-tip mechanism and linkage system may require re-engineering the entire system to accommodate a new cabinet design. Thus there has developed a need for an improved mechanism or system to permit interlocking control of multiple drawers and/or panels in a vertical cabinet array. There has also developed a need whereby such a system can be locked and unlocked easily and whereby the locking and unlocking mechanisms can be easily incorporated or installed with such systems. Further, there has developed a need for incorporating such systems in cabinet arrays which use drawers as well as pivotal and slidable panels.

SUMMARY OF THE INVENTION

Briefly, the present invention comprises a modular anti-tip linkage and locking system capable of linking multiple vertical drawers and/or panels and wherein the component parts of the system are susceptible of manufacture from molded plastic and/or extruded or roll form metal materials and wherein the system is capable of utilization with multiple, varied models of cabinet constructions without altering or changing the basic design of the linkage system. The system includes an assembly of parts or elements which are designed to be combined with the telescoping slides associated with each of the drawers and/or sliding panels in a cabinet. The slides are the type which include an inside channel for attachment to a drawer or a sliding panel and an outside channel for attachment to a sidewall of a cabinet. Two or more vertically spaced pairs of slides are utilized and incorporated in such a system, and each slide may have two or more channel elements or members. The anti-tip linkage system requires, however, that there be an inside channel member attached to the drawer or other item that is slidably inserted or pulled from the cabinet and an outside channel member attached to the cabinet wall. Intermediate and connecting telescoping channels may be utilized to link the inside and outside channels.

The anti-tip linkage system thus includes a universal guide housing which is mounted on the inner end of the outside channel of the slide in opposed relation to the telescopically movable inside channel of the slide which is attached to a drawer or sliding panel. The guide housing includes a cam member which is pivotally mounted on the guide housing and which pivots in response to engagement by and interaction with the movement of the telescopically movable inside channel. Additionally, there is mounted in the guide housing at least one, and in most instances two, opposed cam follower members which are slidably mounted in the guide housing and which interact with or follow rotational movement of the cam member. Thus, as the cam member is rotated due to engagement by the inside channel, the cam followers will move vertically upward or downward in response to the rotated position of the cam member which, in turn, has been rotatably positioned in response to movement of the inside channel of the slide and engagement thereof by the inside channel. Cam followers of vertically adjacent slides are interconnected by a non-circular or polygonal cross section or key shaped connecting rod. The connecting rod engages or fits over stubs that project toward each other from the cam followers associated with adjacent drawer slides. The projecting stubs each define a cross sectional or key shaped profile over which the connecting rods will snap or fit.

In a preferred embodiment, the connecting rods comprise an extruded polymeric or extruded or roll formed metal material in the form of a hollow or slotted beam which may, for example, be generally rectangular in cross-sectional configuration with a slot along one side thereof. The shaped end of the connecting rod fits over the congruent or compatibly shaped, cam follower stubs inasmuch as the interior profile of the connecting rod matches the exterior profile of the connecting stubs. Because the connecting rods are made from an extruded polymeric or extruded or roll formed metal material, they may be cut to a desired length correlated to the spacing associated with the slides for the vertical drawers in a cabinet assembly. Thus, the connecting rods may be cut to an appropriate length in the field during repair or installation of the system or may be precut based on predetermined standard lengths for factory assembly.

The inside channel of the slide mechanism operates to engage appropriate cam lobes associated with the cam member thereby rotating the cam member and, in turn, causing the cam member lobes to engage and drive the cam followers slidably mounted in the guide housing. Movement of a guide member in a guide housing by opening a single inside channel thereby pivoting the cam member associated with that channel will spread the cam followers associated with that inside channel slide and its drawer. Such movement will be translated via the connecting rod to the guide member of the next adjacent drawer or slide panel. All of the remaining guide members associated with the separate inside channels will then be blocked from spreading apart as explained in the prior art references incorporated herewith by reference. As a result, attempts to withdraw any inside slide channel will be prevented since the cam members and cam followers are "locked" in position. In other words, cam members which are locked in position each include a second peripheral lobe which blocks withdrawal of the associated inside slide channel. In this manner, the opening of a single drawer will effect locking of all associated drawers and slide mounted items in a vertical array.

The system further includes the capability of attachment of an auxiliary cam housing to the top one of the guide housings in an anti-tilt linkage mechanism array. The auxiliary cam housing includes an auxiliary cam member which may be moved or translated to engage a stud of a cam follower at the top end of the anti-tilt mechanism array and hold that stud in a non-moveable position. Thus, the connected cam followers and connecting rods are similarly held thereby locking all of the inside channel slides in the closed position. The auxiliary cam member may be slidably moved to engage the stud by means of a linkage arm or a cable associated with a locking mechanism mounted on the cabinet. The connection between the cable and auxiliary cam may be elastic to permit closure of an open drawer, for example.

The system further includes a mechanism for locking a front panel door, having a strike opening, in a closed position where the panel pivots over the front opening in the cabinet between a closed and an open position and wherein the panel may optionally be mounted on a slide that permits recessing the panel within the cabinet. The mechanism for locking a panel in a closed position includes a bolt member pivotally mounted in a housing attached to an outside channel of a slide in the cabinet. The bolt member pivots in response to actuation by a linkage arm or cable. The pivotal bolt member may thus be moved between a non-strike engaging or open position and a closed position or strike engaging position. More specifically, when the pivotal front panel is in a closed position the lower or side edge of the panel defines a strike. The pivotal bolt member includes a projection designed to engage the panel strike and hold the panel in the closed position. The bolt member thus comprises a biased lever arm which is actuated by means of a linkage arm or cable for movement between a strike engaging and a strike release position. The linkage or cable member may be attached to a locking mechanism for the cabinet.

The locking mechanism for a panel may also include connections to the anti-tip interlocking mechanism for the drawers and therefore may actuate both the anti-tip interlocking and locking mechanism for the drawers, as well as the locking mechanism for pivotal panel. Various designs of key actuated locking mechanisms are depicted including a lock having an eccentric cam and a rack and pinion construction to enable simultaneous movement and control of one or multiple actuators (cables or linkage arms). Additionally, a pedestal or alternative inside slide channel locking mechanism is disclosed.

Thus it is an object of the invention to provide an improved cabinet anti-tip interlock system.

It is a further object of the invention to provide an improved anti-tip interlock system for cabinet drawers as well as sliding or pivoting panels.

Another object of the invention is to provide an improved anti-tip interlock mechanism which may be easily adjusted for differing cabinet and drawer constructions.

A further object of the invention is to provide an improved cabinet anti-tip mechanism which includes the capability of utilizing universal molded component parts that may be snap-fitted into slide channel members and easily utilized in combination with drawers and cabinets of various sizes and constructions including cabinets having variable drawer size and variable spacing of drawers.

Yet another object of the invention is to provide an improved construction for interconnecting vertically adjacent locking mechanisms associated with cabinet interlock systems.

Another object of the invention is to provide a linkage mechanism having locks for locking a set of drawers in a cabinet wherein the drawer anti-tip interlock system may be utilized as the locking mechanism for the cabinet.

Another object of the invention is to provide an easily replaceable, repairable and installable cabinet drawer anti-tip interlock system, including a locking feature and further capable of use with drawers, slidable panels and pivotal panels in a single cabinet.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 11A is a cross sectional view of the connecting rod of FIG. 6 taken along the line 6—6;

FIG. 11B is a cross sectional view of an alternative design for a connecting rod;

FIG. 12 is an isometric view of the rivet or pivot connector for attaching the cam of FIGS. 7 and 8 to the guide housing of FIG. 6 in the anti-tip linkage mechanism of the invention;

DESCRIPTION OF THE PREFERRED EMBODIMENT

Figure 1:
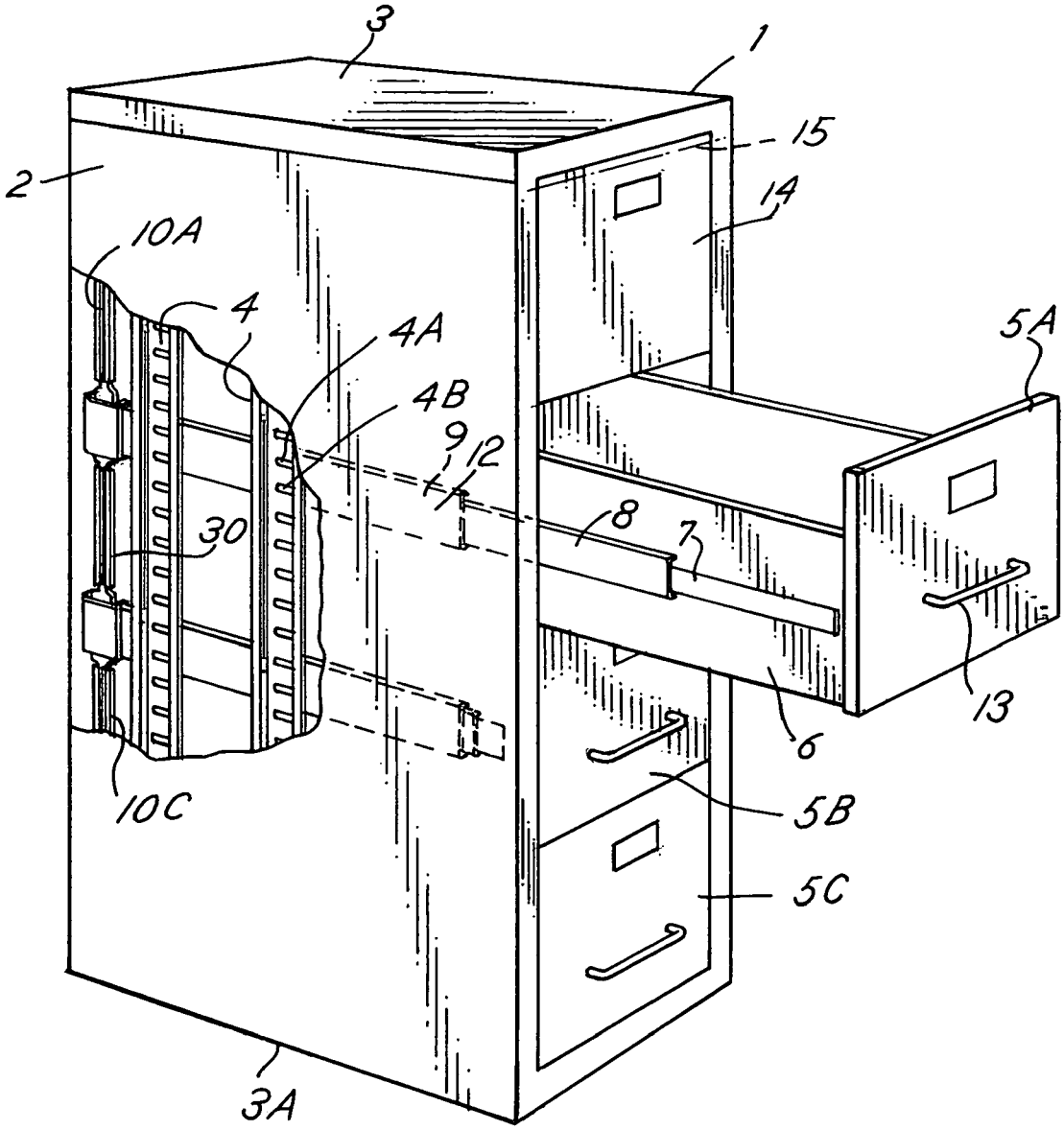
FIG. 1 is an isometric view of a typical vertical file cabinet having multiple drawers and a pivotal front panel.

FIG. 1 illustrates the environment in which the invention is incorporated. That environment comprises a vertical filing cabinet 1 having a side cabinet wall 2, a top wall 3 and further including a series of drawers 5A, 5B and 5C. The drawers 5A, 5B and 5C are arrayed vertically one above the other and supported on slides 12 attached to opposite side cabinet walls such as wall 2 by means of vertical brackets or supports 4 which are welded to the walls 2. More specifically the vertical supports or brackets 4 include a series of slots 4A, 4B, etc. which receive tabs projecting from each slide 12 for support of the slide 12 a spaced distance from the side walls 2 so that the slides 12 will have adequate clearance when slide channels such as slide channels 7 and 8 are telescopically extended from the cabinet 1 through the front of the cabinet 1. Thus, each drawer, for example, drawer 5A includes a pair of slide channels 12 supported within the cabinet 1 by brackets 4 welded to opposed cabinet walls 2. The slides 12 include an outside channel 9, and intermediate telescopically sliding channel 8 and an inner slide channel 7 which is attached to the side wall 6 of a cabinet drawer 5A. The same slide construction is provided on both sides of the cabinet drawer 5A so that the drawer 5A may be moved into and out of the cabinet 1 in response to pulling on a handle 13. In the example of the invention depicted three drawers 5A, 5B and 5C are provided vertically arrayed one above the other and each supported by a slide or slide assembly 12.

Additionally the vertical cabinet 1 includes a tiltable or pivotal front panel 14 which is mounted on pivot pins (not shown in FIG. 1) for pivoting about a horizontal axis 15. The pivot pins are mounted typically on a slide mechanism permitting the panel 14 to be pivoted upwardly and outwardly from the position shown in FIG. 1 and then moved inwardly along channels (not shown) into the interior of the cabinet 1 on a slide mechanism similar to the slide assembly 12 utilized for support of the drawers 5A, 5B and 5C.

The subject matter of the invention relates to an anti-tip interlock mechanism associated with the slides 12 which are vertically arrayed one above the other and associated respectively with separate drawers 5A, 5B and 5C. An objective of the anti-tip mechanism is to enable opening of a single drawer 5A and preclude the opening of additional drawers 5B and 5C. Thus only a single drawer 5A or 5B or 5C may be extended to an open or extended position at any given time. By limiting the number of drawers that may move to an open position, a user of the cabinet will avoid the potential for tipping of the cabinet 1 due to imbalance resulting from opening of drawers which are filled with paper and other items. In general the anti-tip mechanism for the drawers provides for the interlocking arrangement described wherein only a single drawer may be opened at any given time.

In addition, the subject matter of the invention provides further features including means for locking all of the drawers in a closed position and means for locking of the pivotal or tiltable front panel 14. In other words, the anti-tip mechanism may include a feature which permits full locking of the cabinet 1 to maintain security thereof by locking all of the drawers and the panel 14 in a closed position.

In review the subject matter of the invention includes, first, an anti-tip interlocking mechanism which prevents tipping of the cabinet by virtue of limiting the number of drawers which may be opened at any given time; second, a mechanism for locking all of the drawers in a closed position; third, a mechanism for locking and unlocking a pivotal panel 14 alone or in combination with an array of vertical drawers and/or additional panels; and, fourth, a key actuated locking mechanism for use in combination with the other features.

The Interlock Anti-Tip Mechanism

Figure 13:
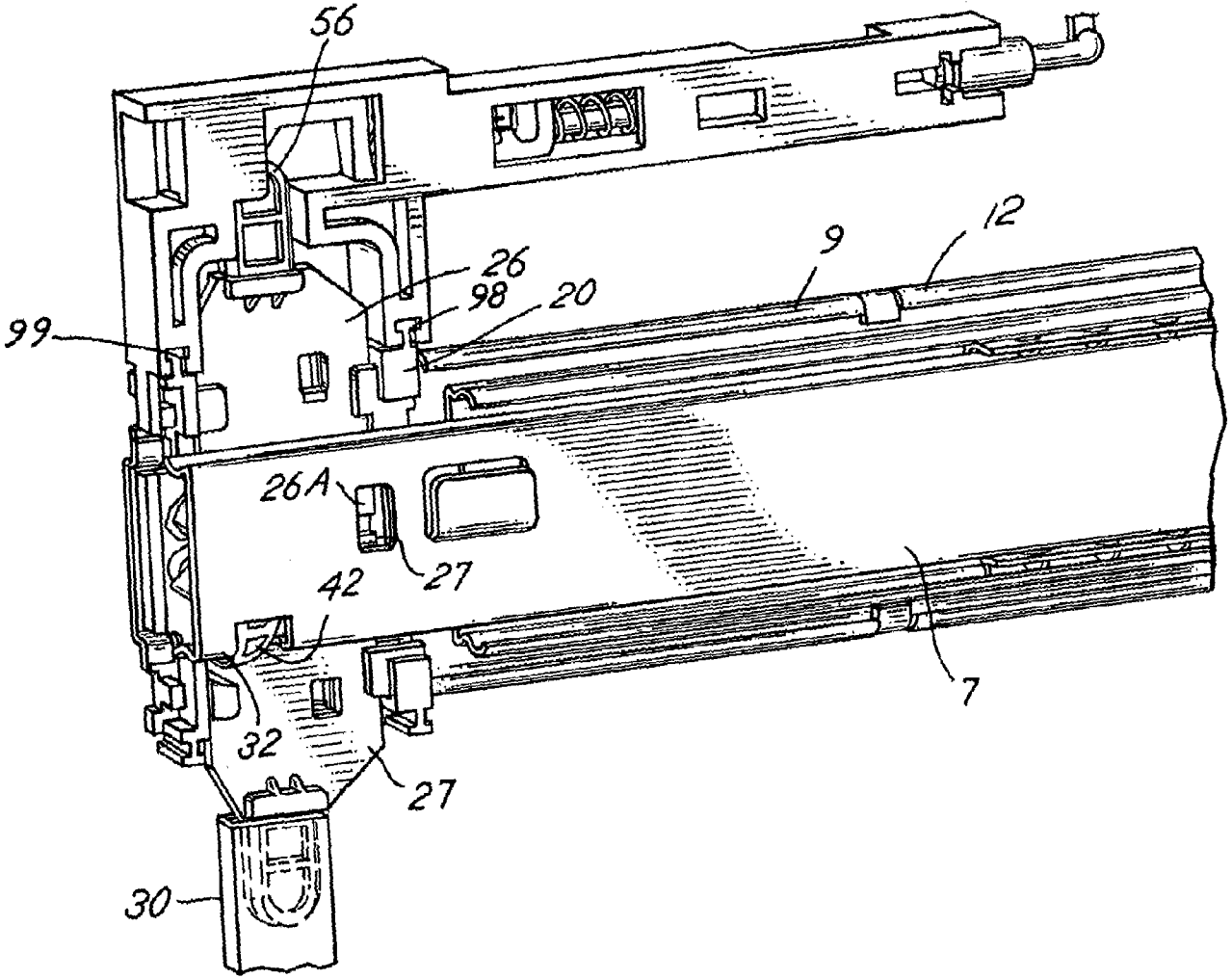
FIG. 13 is an isometric view of the interlocking linkage mechanism further incorporating an auxiliary cam housing and an auxiliary cam actuator.
Figure 14:
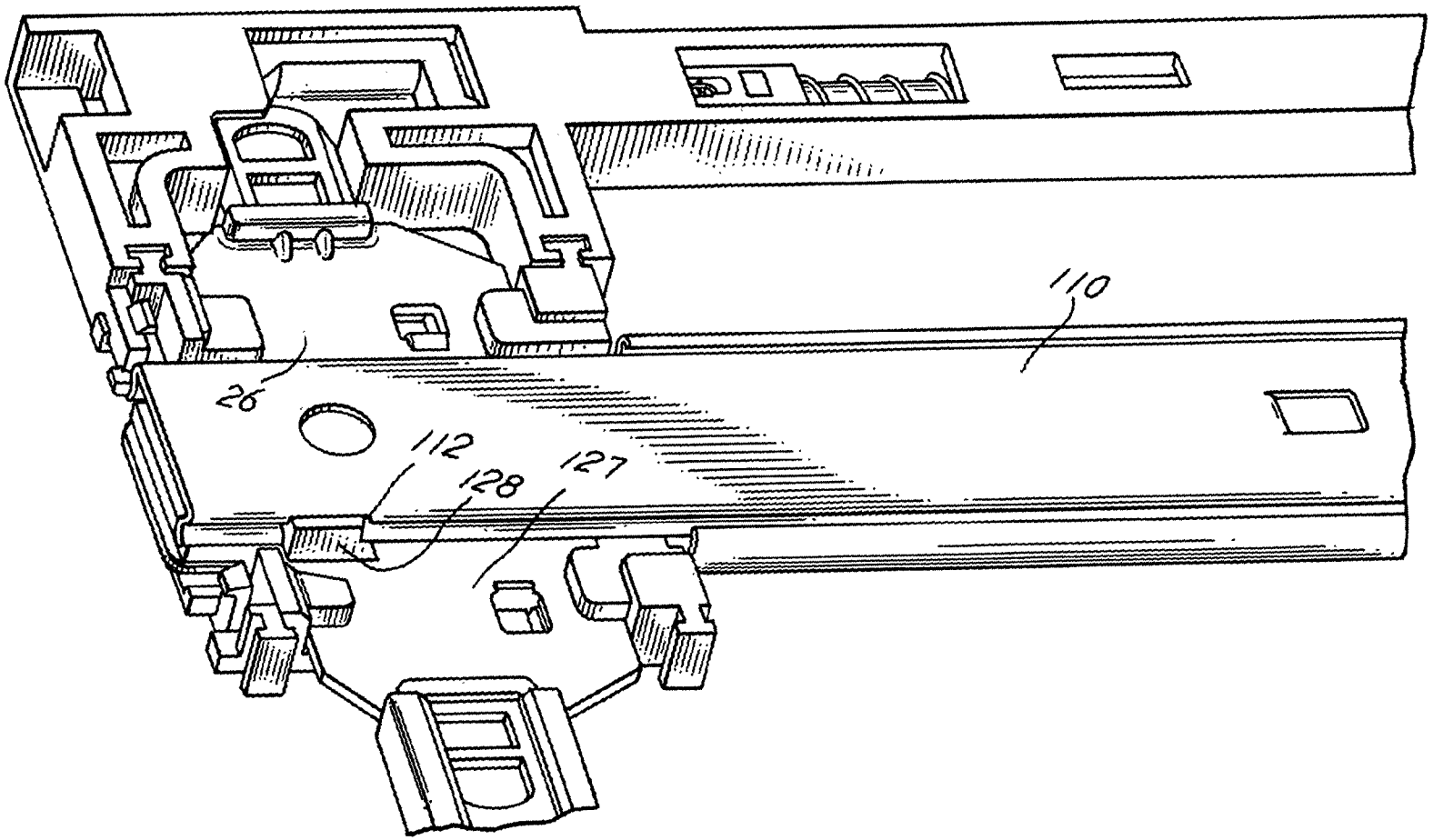
FIG. 14 is an isometric view of an alternative cam follower locking construction for an inside channel.
Figure 15:
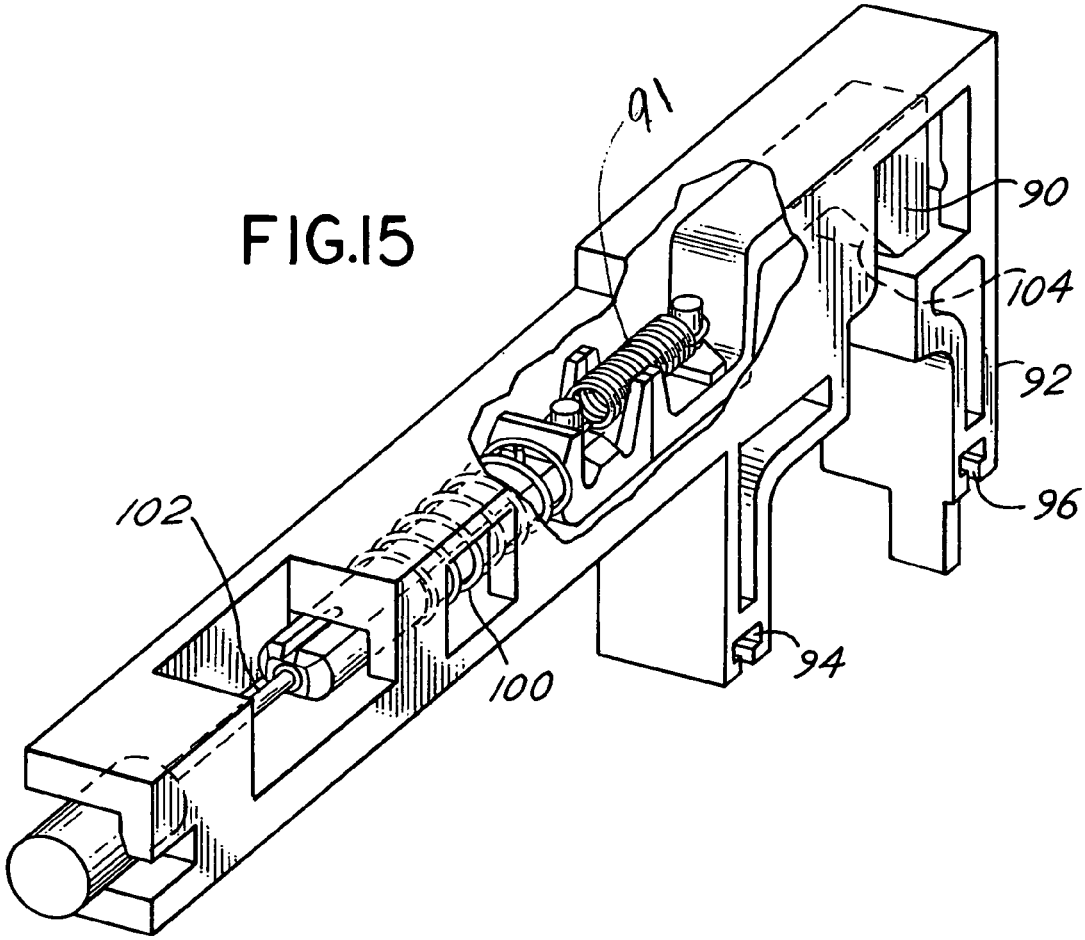
FIG. 15 is an isometric cut away view of the auxiliary cam housing utilized in the embodiment depicted in FIG. 13.
Figure 16:
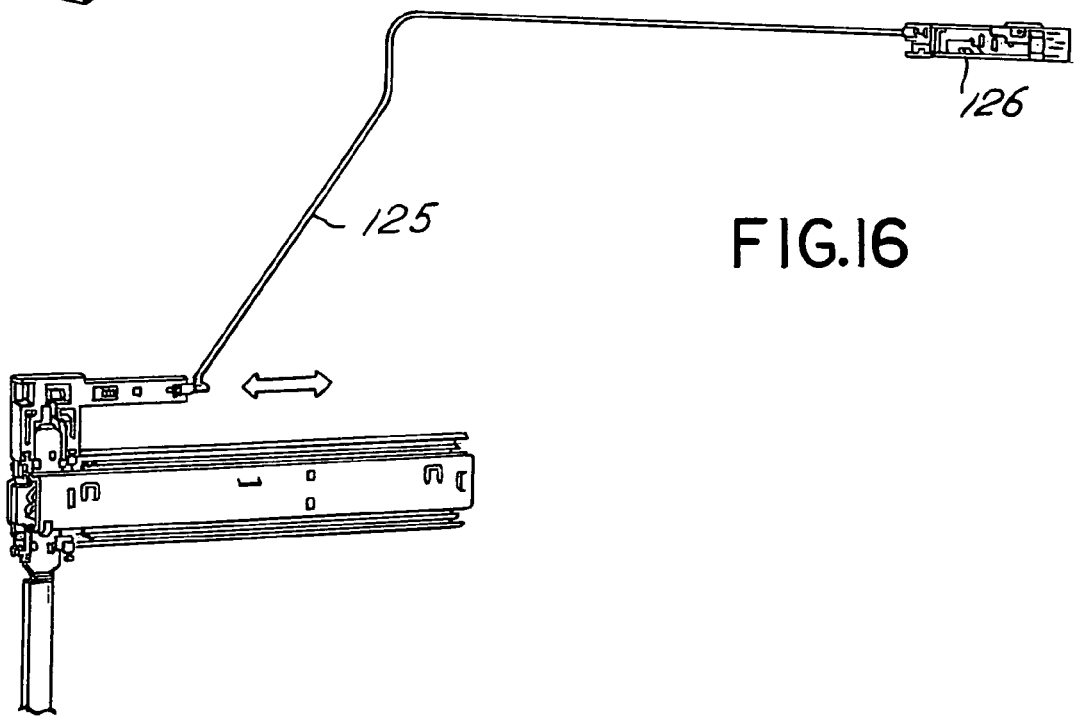
FIG. 16 is an isometric view depicting a linkage bar for operating the auxiliary cam housing assembly of FIGS. 13 and 15.
Figure 17:
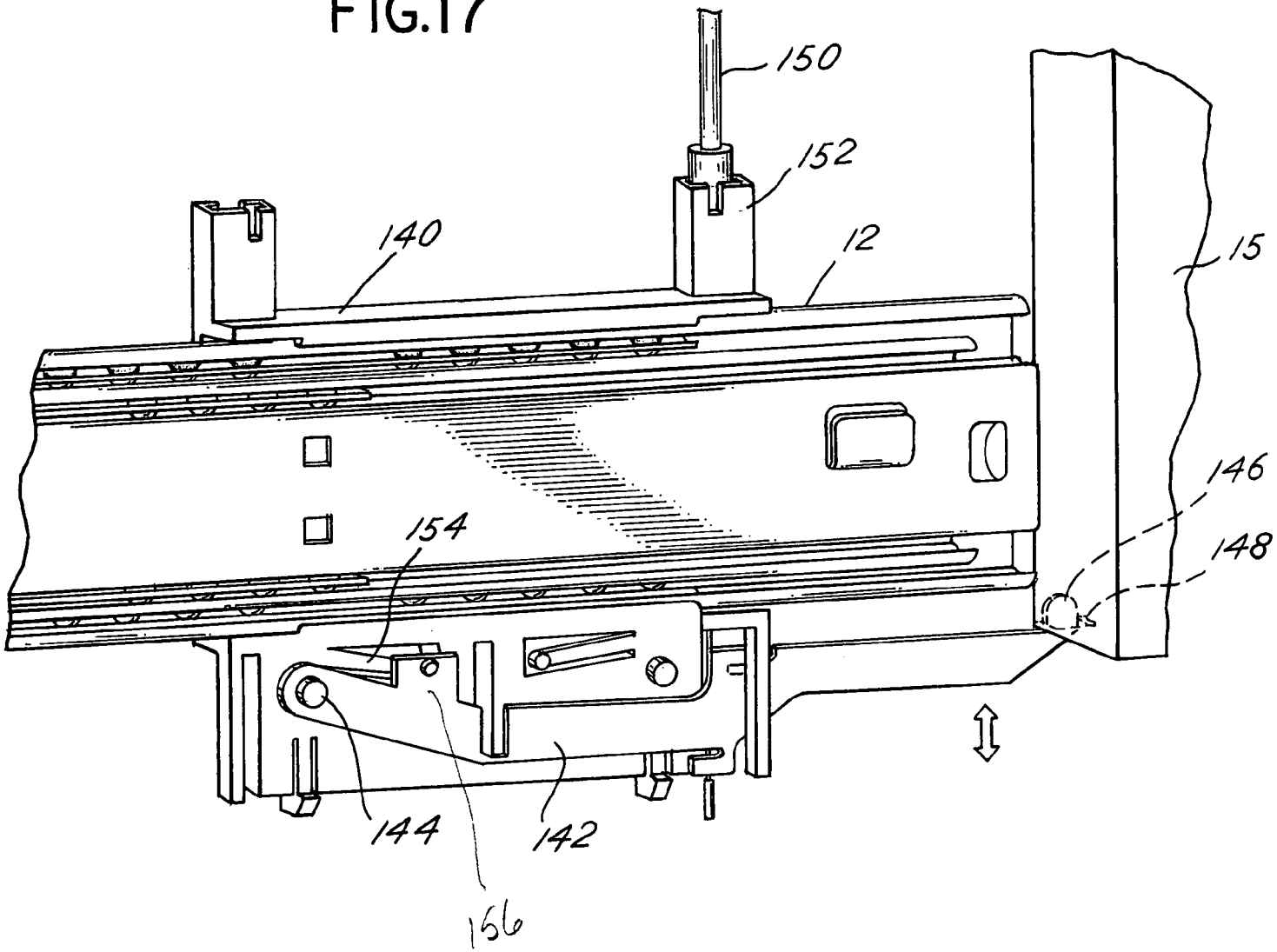
FIG. 17 depicts in an isometric view a locking mechanism which may be incorporated with a slide assembly for locking a horizontally pivotal panel door in a closed position in a vertical cabinet.
Figure 18:
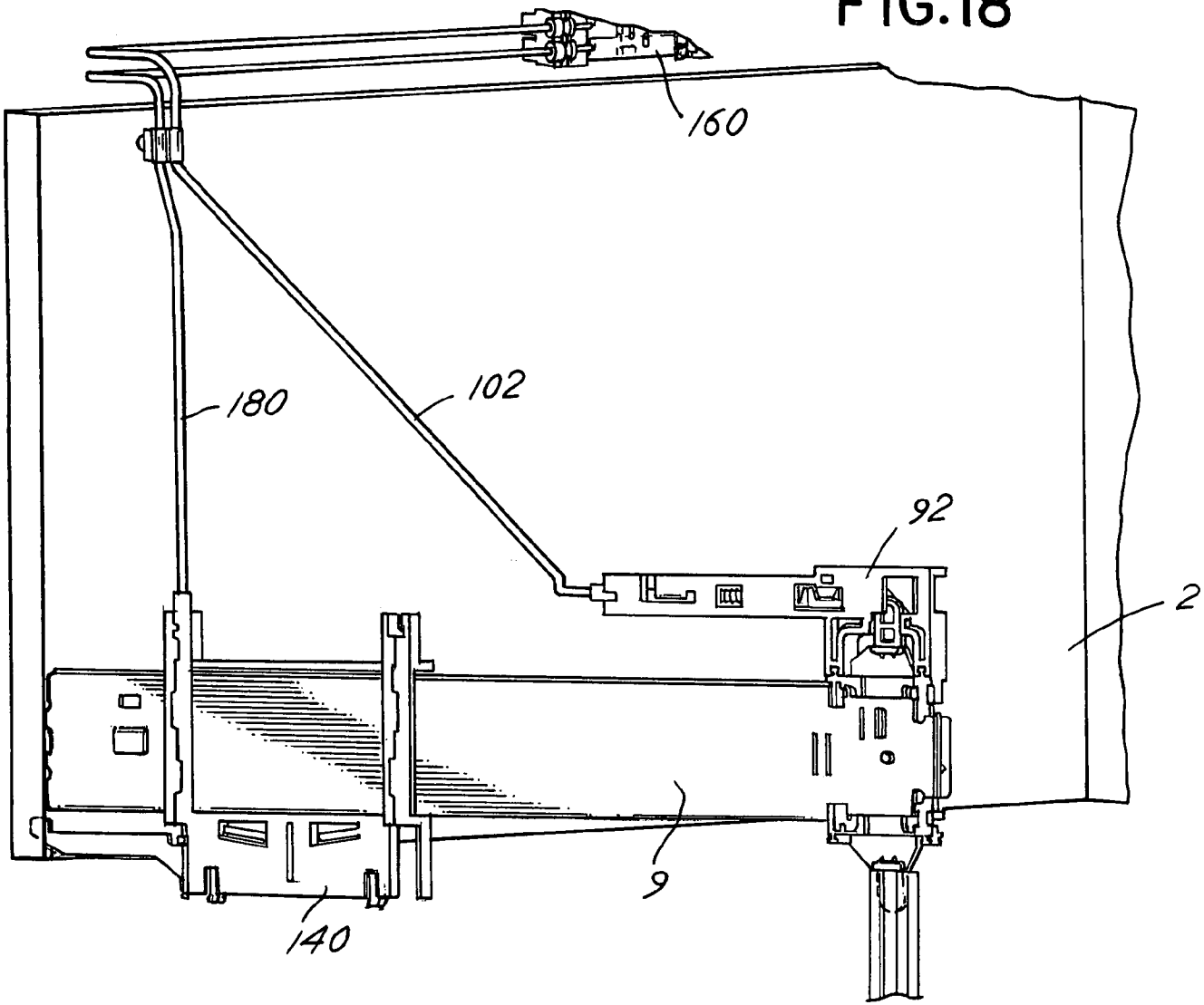
FIG. 18 is an isometric view depicting the combination of a locking mechanism as depicted in FIG. 17 with a locking mechanism as depicted in FIG. 13.
Figure 19:
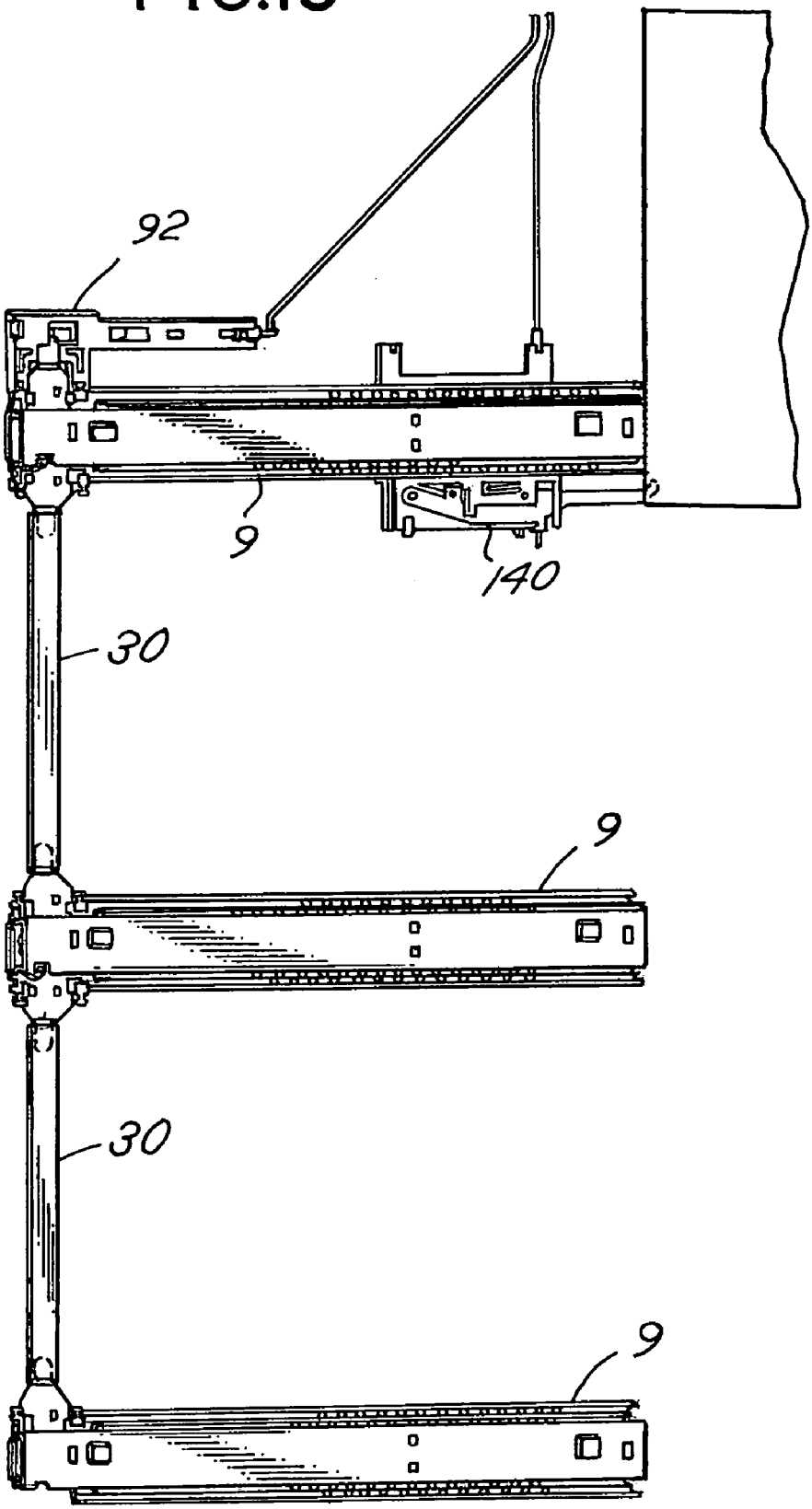
FIG. 19 is a plan view of an interlocking linkage mechanism incorporating the features of anti-tip, auxiliary cam locking and panel door locking.
Figure 20:
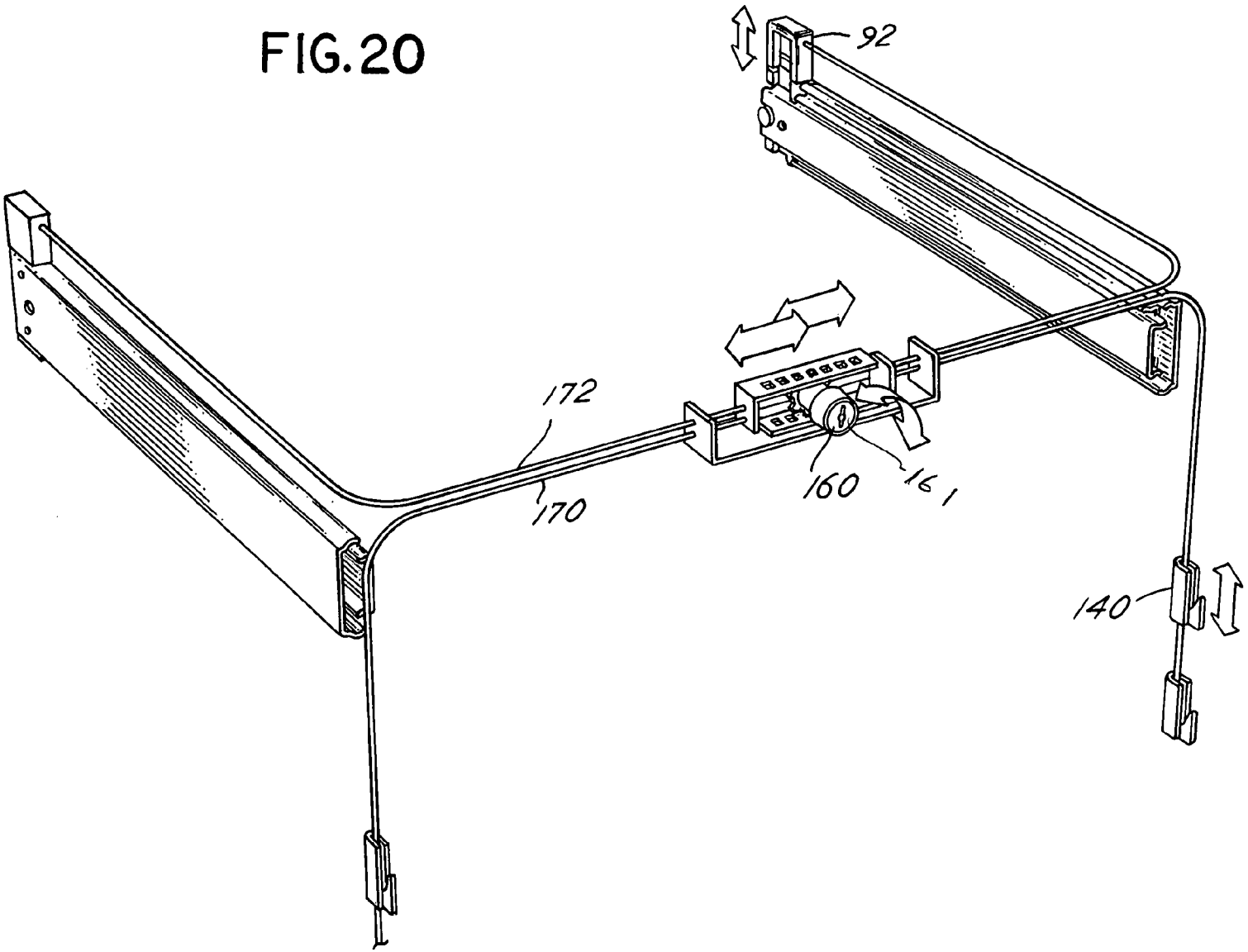
FIG. 20 illustrates in an isometric view a cable actuated interlocking linkage mechanism actuated by means of a locking assembly positioned on the front side of a vertical cabinet.

FIGS. 2–12 deal particularly with the anti-tip interlock mechanism. FIGS. 13, 15 and 16 are directed principally to an auxiliary cam mechanism which effects locking all of the drawers of vertical file cabinet drawers. FIG. 17 is directed to the mechanism for locking and unlocking a front panel door 14. FIGS. 18 and 19 illustrate a linkage bar assembly which is utilized in combination with a pivotal or cantilever sliding door locking assembly and the auxiliary drawer locking assembly. FIG. 20 illustrates an alternative cabinet locking embodiment wherein cables are utilized rather than linkage bars as depicted in FIG. 19. FIGS. 21–24 illustrate features of a cabinet lock useful for locking cabinet drawers as well as a front panel. FIG. 14 illustrates an alternative anti-tilt slide locking mechanism.

Figure 2:
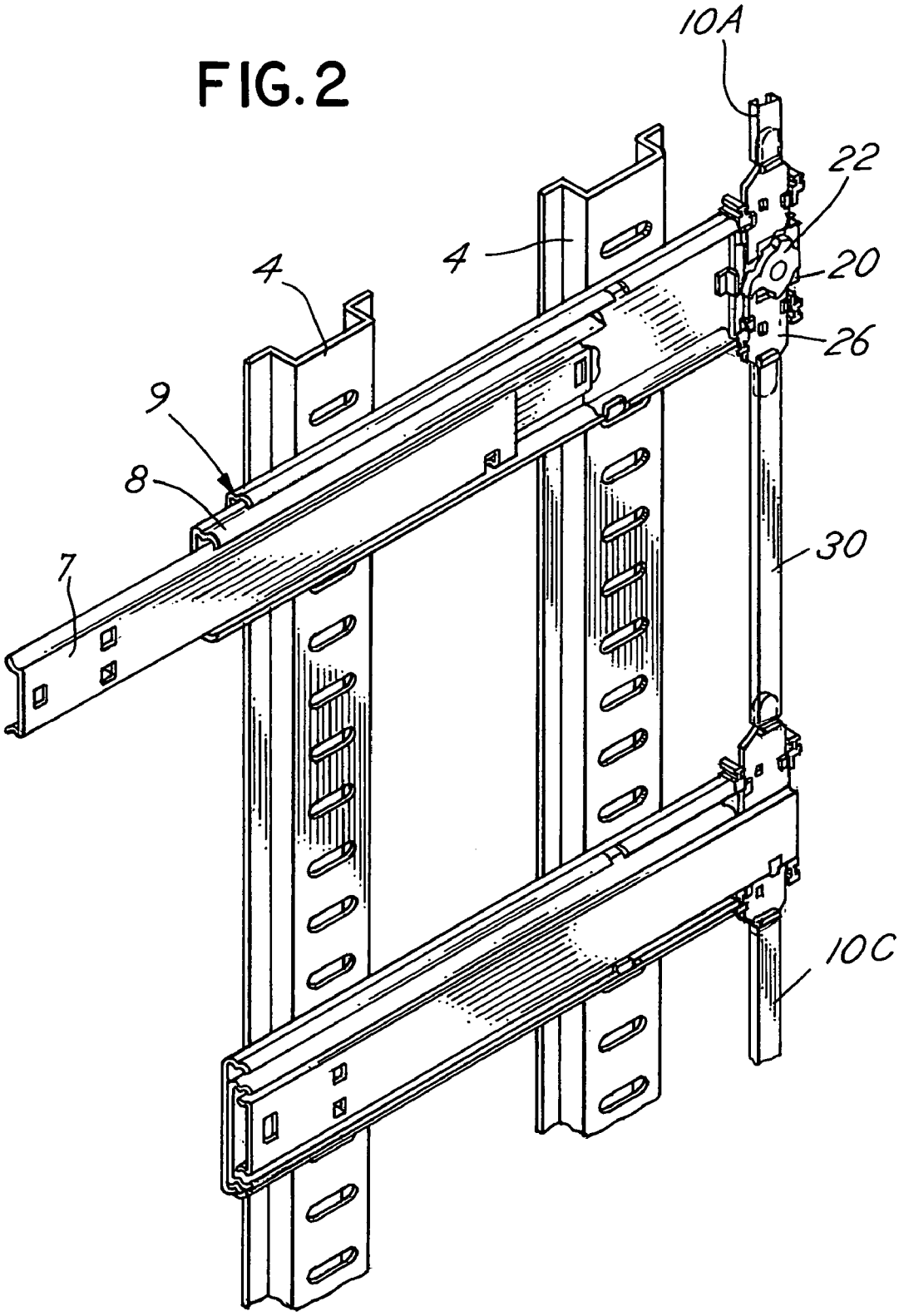
FIG. 2 is an isometric view of the cabinet interlock system of the present invention as incorporated in vertically adjacent slide assemblies or slides for a cabinet.
Figure 10:
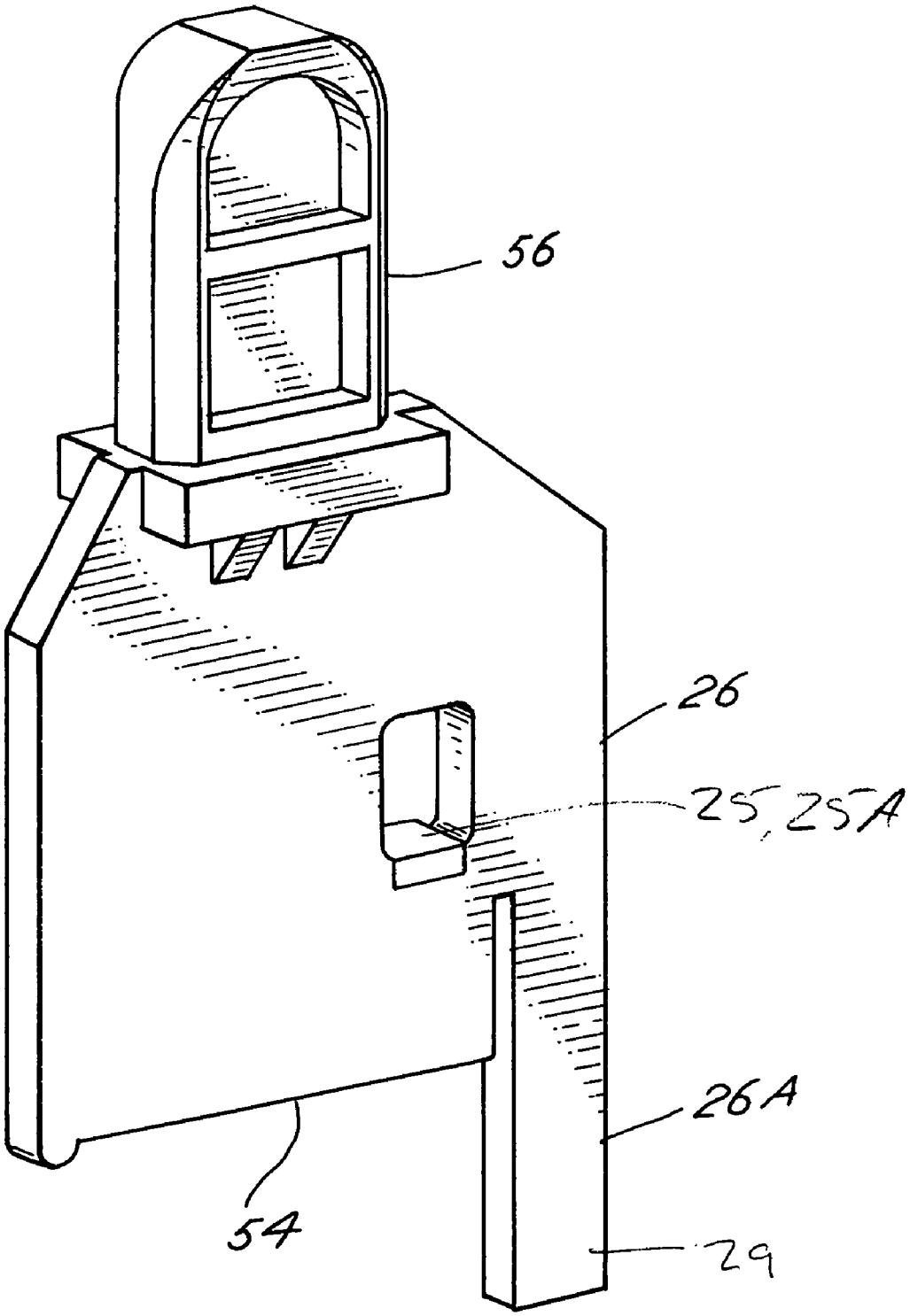
FIG. 10 is an isometric view of a cam follower which is incorporated in the anti-tip interlocking linkage mechanism of the invention.

Referring therefore to FIGS. 2–12, the slide assembly 12 comprises an outside channel 9 fixed to the vertical support brackets 4. An intermediate slide channel 8 is slidably and telescopically mounted within the outside channel 12. An inside channel 7 is slidably mounted to telescope within the intermediate channel 8. The channels 7 and 8 may be extended telescopically as illustrated in FIG. 2 between a retracted position and an extended position. The principal component parts of the anti-tip mechanism which are incorporated in the slide assemblies 12 include a guide housing 20, more particularly depicted in FIG. 7 as guide housing 20, a pivotal cam 22, as more particularly illustrated in FIGS. 8 and 9, which is pivotally mounted by means of a rivet 24 in the guide housing 20. The rivet 24 is depicted in FIG. 12. The assembly further includes cam followers 26 as depicted in FIG. 10 which fit slidably within the guide housing 20 on opposite sides of the cam 22 and move slidably in response to movement of the cam 22 as the cam 22 rotates about the pivot member 24. Further, an extruded or roll formed non-circular cross-section, connecting rod extends between and interconnects cam followers 26 of vertically adjacent assemblies of the interlock mechanism mounted on vertically adjacent slides 12. That is, as depicted in FIG. 2, for example, the connecting rod 30 connects a cam follower 26 mounted on a lower slide assembly 12 with a cam follower 26 mounted on the next adjacent upper slide assembly 12. In operation as will be described hereinafter, opening of one of the slide assemblies 12 by withdrawal of inside channel 7 will effect movement of one of the cam followers 26 in response to actuation by the cam 22 to thereby cause all of the connected cam followers 26 to be locked thereby precluding rotation of the remaining cams 22 and withdrawal of the remaining inside slide channels 7 within the cabinet. Those inside slide channels 7 are thus locked in an inward, locked and closed condition. This prevents the drawers 5 associated with such locked slide channels 7 from being opened. Thus movement of an inside slide channel 7 from a closed position toward an open position will effectively lock all of the remaining slide channels 7 in a closed condition. Opening of one drawer 5 precludes opening of the additional drawers 5.

This type of mechanism is generally depicted and described in U.S. Pat. No. 6,238,024 B1. The subject matter of the present invention constitutes a significant improvement thereover inasmuch as the construction of the guide housing 20, rotatable cam 22, cam followers 26, and connecting rod 30 are significantly different and simplify the assembly process associated with such an anti-tip mechanism as well as enable field assembly and ease of repair.

Figure 3:
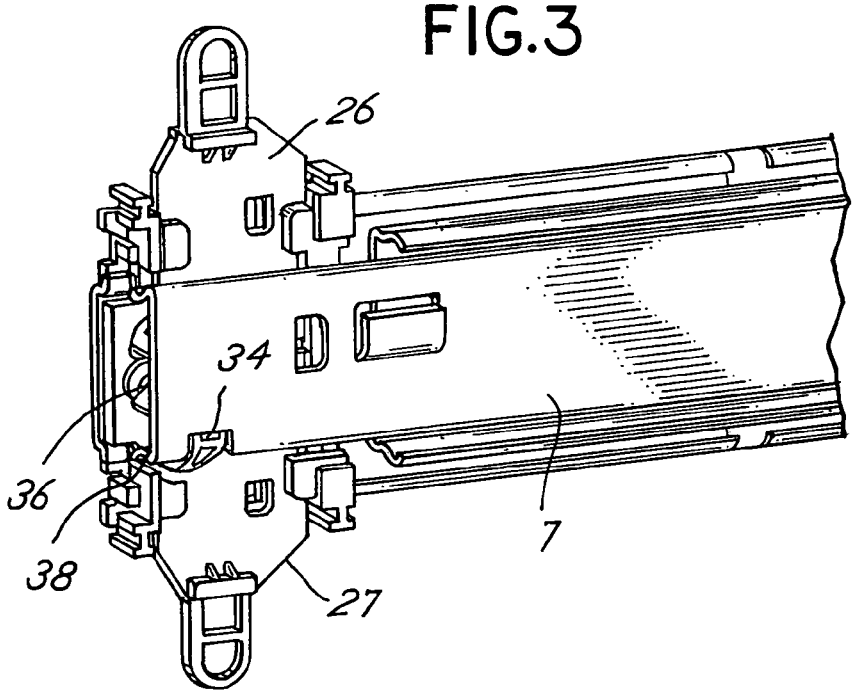
FIG. 3 is an isometric view of a slide comprised of an inside channel and an outside channel and further incorporating the elements comprising the cabinet anti-tip interlock system.
Figure 4:
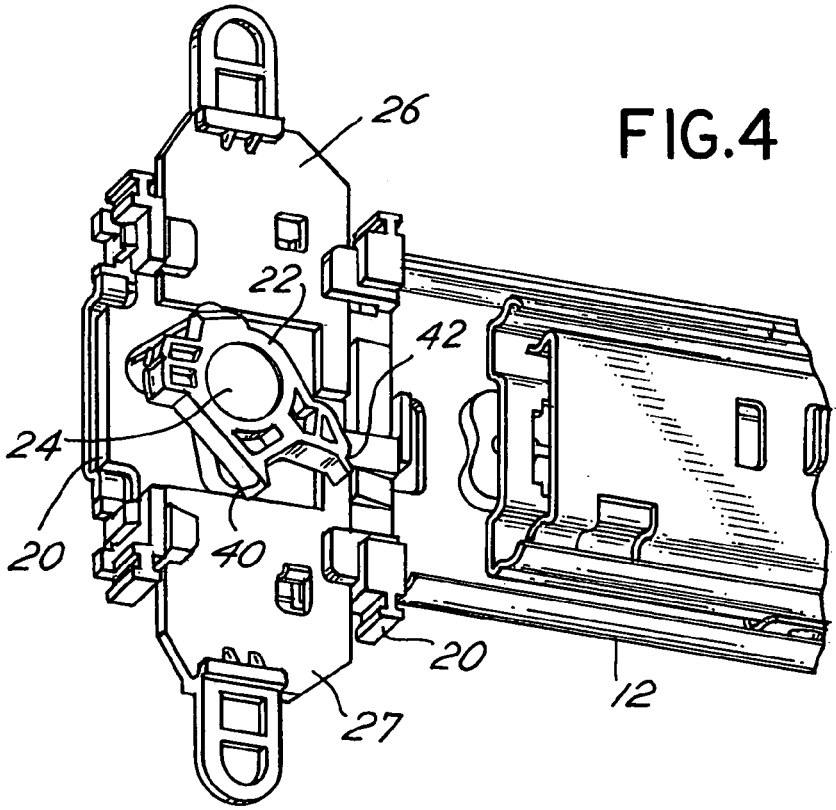
FIG. 4 is an isometric view of the assembly of FIG. 3 wherein the inside channel has been partially opened to reveal the mechanism of the interlock system.
Figure 5:
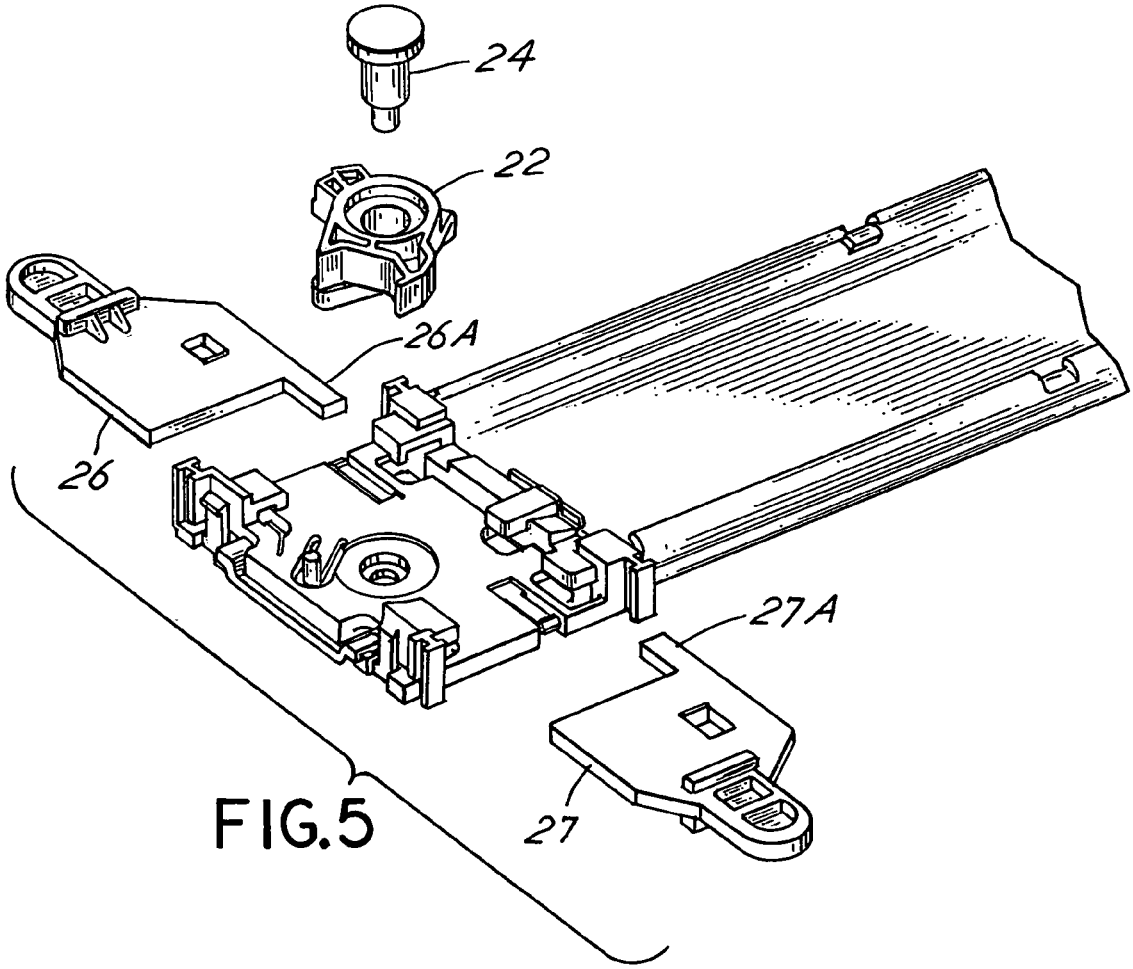
FIG. 5 is an exploded isometric view of the assembly of FIG. 4.
Figure 6:
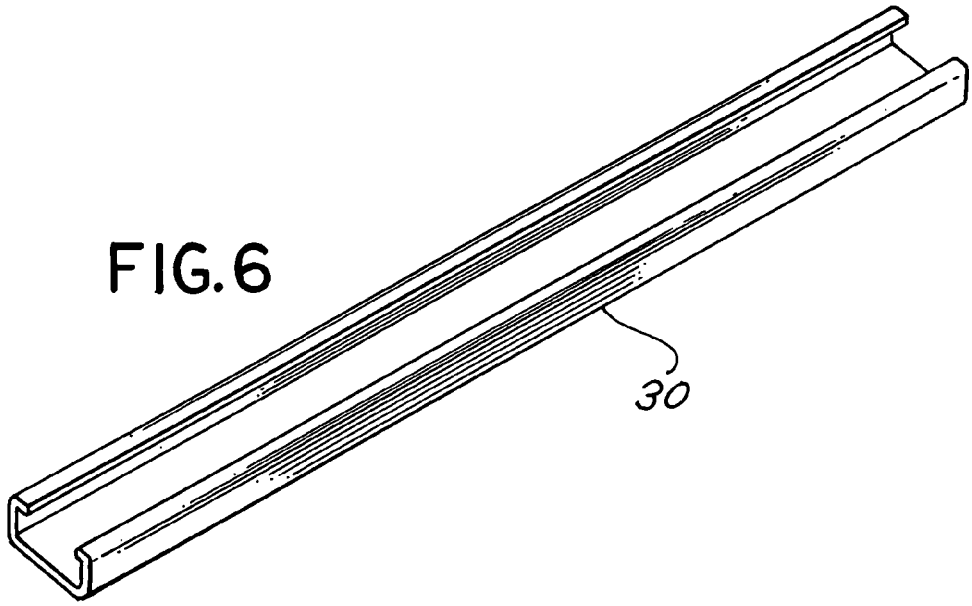
FIG. 6 is an isometric view of the connecting rod utilized for connecting vertically adjacent channel locking mechanisms of the anti-tip systems of the invention.

Referring to the FIGS. 3–9, the guide housing 20 is snap-fitted into and engages with the inside end 11 of the outside channel 9 and is held at the inside end of the outside channel 9 in opposed relation to closed inside channel 7. The rotatable cam 22 is held by the rivet or pin 24 on housing 20 and pin 24 is snap fitted to housing 20 through a pivot opening 23 of the rotatable cam 22. Slidably mounted on the opposite vertical sides of the guide housing 20 are first and second cam followers 26 and 27. The cam followers 26, 27 are identical and thus a description of follower 26 applies to follower 27. Upper cam follower 26 is arranged to slidably move within the guide housing 20 in response to rotational movement of the cam 22. The second or lower cam follower 27 is likewise responsive to the rotational movement of the cam 22. The rotational movement of the cam 22 is effected by movement of the inside channel 7. Specifically a side rail 32 of the inside channel 7 includes a slot 34. The slot 34 is positioned inwardly from the extreme end 36 of the inside channel 7. In this manner the slot 34 defines a projecting tang or tab 38. The tab or tang 38 has a width enabling it to fit between a first peripheral lobe 40 extending radially from the cam 22 and a second, spaced peripheral lobe 42 extending radially from the cam 22. When the inside channel 7 is in the closed position, tab 38 will have engaged the first peripheral lobe 40 causing the cam 22 to rotate the position as illustrated in FIG. 3. The second peripheral lobe 42 thus will be positioned in the path of tab 38 if the channel 7 is subsequently withdrawn or moved toward the open position. A detent member, or arm 44, projecting from the underside of the cam 22 extends radially outwardly from the rotation axis of the cam 22 and cooperates with a detent lug 46 on the inside of the guide housing 20. Thus, as the detent arm 44 passes over the lug 46, the pivotal cam 22 will tend to be held in a detent position such as illustrated in FIG. 3, or a released detent position such as illustrated in FIG. 4.

The cam 22 further includes a third peripheral lobe 48 and a fourth peripheral lobe 50 extending in opposite directions, one from the other. The third and fourth peripheral lobes 48 and 50 are designed to engage against the respective cam followers 26 and 27 which are slidably positioned for vertical movement within the guide housing 20. More specifically, follower 26 as shown in FIG. 10, includes a follower surface 54 which may be engaged by third cam lobe thereby slidably extending the follower 26 vertically. Similarly, fourth cam lobe 50 will engage surface 54 of follower 27. Both of the cam followers 26 and 27 are thus extended vertically in opposite directions by rotation of the cam 22 as channel 7 is moved to the open position.

The cam followers 26, 27 are identical in construction and are positioned in guide housing 20 on opposite sides of cam 22 with a side leg 29 of each follower 26, 27 in opposed relation when mounted in housing 20. When the channel 7 is closed so that third and fourth lobes 48, 50 are not engaging surface 54, the ends of legs 29 touch to thereby control inward travel of followers 26, 27. The followers 26, 27 also include a projecting stub or stud 56 extending vertically outwardly from the followers 26, 27. The stub 56 has a generally non-circular, e.g. polygonal cross sectional shape. In the embodiment depicted, the cross sectional shape is generally rectangular. The stub 56 is designed to receive a connecting rod 30.

Thus, the connecting rod 30 is in the form of a rectangular member having a rectangular cross section center channel 60 as depicted in FIG. 11A. FIG. 11B illustrates an alternative cross sectional shape which is also compatible with stud 56, but which also includes stiffening ribs 57. The cross sectional shape and size of the channel 60 is congruent with the cross sectional size and shape of the stub 56. Thus, the connecting rod 30 may be fitted over and engaged with the stud or stub 56. Note that the connecting rod 30 may be made by extrusion methods. For example, the rod 30 may be made by extruding a polymeric material or, alternatively, extruding or roll forming a metal material such as an aluminum alloy. Importantly, the configuration of the stud 56 and the internal configuration of the connecting rod 30 are non-circular so that the connecting rod 30 will define a bore or receptacle that is attached to the stud 56 in a non-rotatable manner. Additionally, since the connecting rod 30 has a simple extruded configuration, it may be cut to appropriate length in the field during the assembly process to insure that the tolerances required to effect the anti-tip operation of the cabinet will be maintained.

In operation, the inner channel 7 associated with the series of vertical drawers 5A, 5B, 5C when each of the drawers 5A, 5B, 5C is in the closed position will cause the cams 22 to be rotated to the position as illustrated in FIG. 3. When all of the cams 22 are in this position, the third and fourth peripheral lobes 48, 50 are not engaged with the cam followers 26 and 27 and thus do not cause separation of said followers 26 and 27. However, upon opening of a single drawer, 5A for example, the inside channel 7 will be moved outwardly in the slide assembly 12 causing the tab 38 to engage the second peripheral lobe 42 thereby pivoting the cam 22 and peripheral lobe 42 as depicted in FIG. 4. Upon such pivoting action, the third and fourth peripheral lobes 48 and 50 will engage respectively the cam followers 26 and 27 causing those followers 26, 27 to move vertically outward from the pivot axis of the pivot pin 24 as a result of the rotation of the cam 22. Of course, upon this pivoting motion, the detent arm 44 will move over to the detent lug 46. Further, the movement will cause the extension of connecting rods 30 associated with the followers 26 and 27 to move vertically in opposite directions. Upon such vertical movement in opposite directions, any connected followers 26 of vertically adjacent drawers will be precluded from any vertical movement. In practice, the opening of a single drawer will effectively preclude vertical movement of all followers 26, 27. Because the vertical followers, such as followers 26 and 27 are immovable, the associated cams 22 cannot be effectively rotated, and the inside channel 7 of the additional drawers 5B, 5C will be engaged by the second lobe 42 and precluded from movement. That is, the associated followers 26 and 27 will be incapable of being further spaced apart one from the other. In other words, all of the additional inside channels 7 will be locked against the retaining second peripheral lobe 42 associated therewith. From a functional viewpoint, this is similar to the mechanism depicted in U.S. Pat. No. 6,238,024 B1. However, from a construction viewpoint, the difference is significant inasmuch as the design of the housing 20, cam 22, followers 26 and 27, and connecting rod 30 are significantly distinct.

Note, engagement of the legs 29 of the cam followers 26 and 27 precludes their movement toward one another under the circumstances described. That is, when the followers 26 and 27 are positioned as depicted in FIG. 3 with the inside channel 7 in the closed position, the projecting legs 29 extend toward one another and engage. Thus, the followers 26 and 27 cannot be moved toward one another and cam 22 cannot be rotated. Opening one inside channel 7 will, in fact, cause one pair of followers 26 and 27 to become spaced apart one from the other. However, upon the spacing of one set of cam followers 26 and 27 from one another, the remaining cam followers 26, 27 in a series are precluded from becoming spaced apart and thus the inside channels 7 associated therewith are maintained in the locked position.

Figure 7:
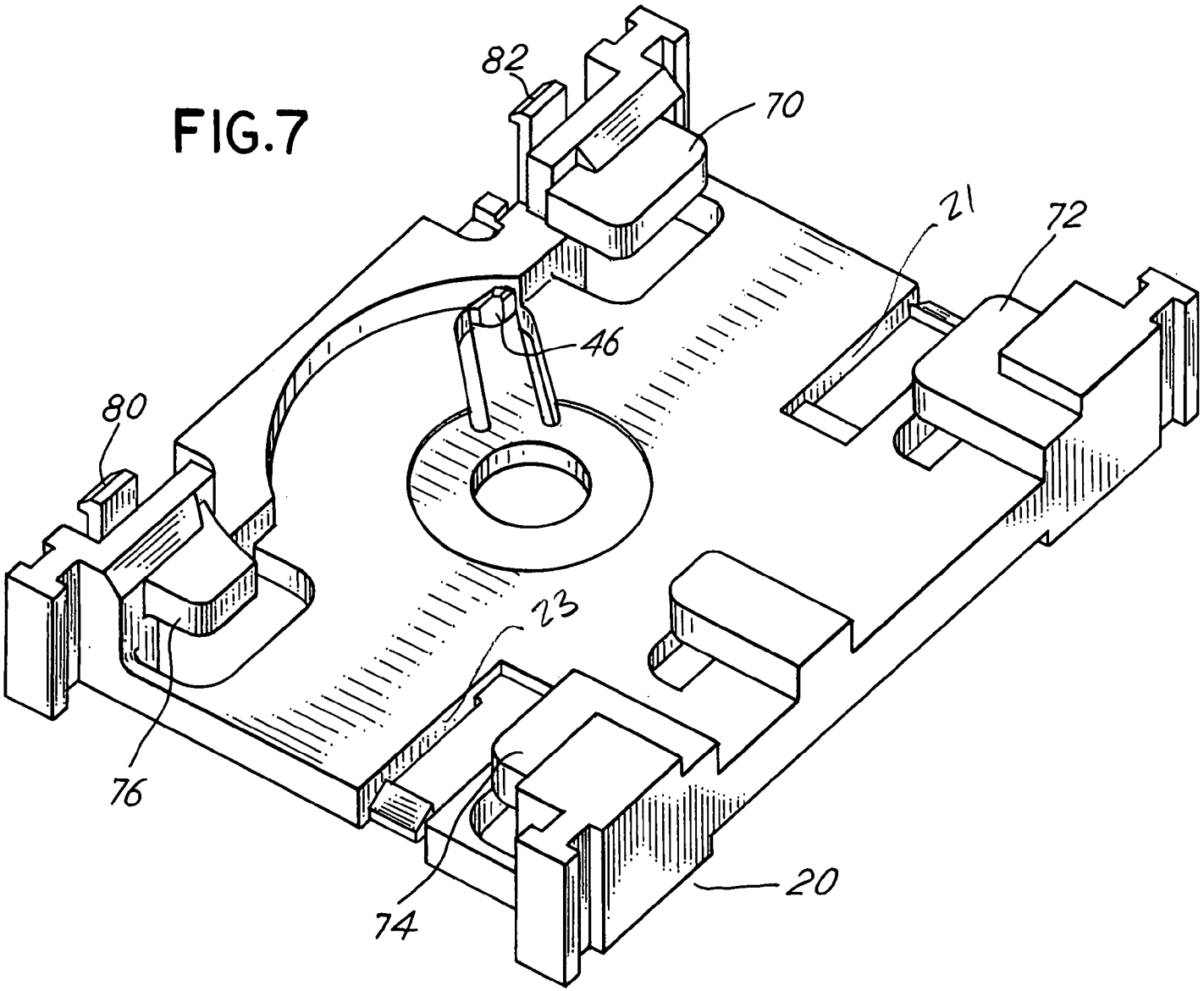
FIG. 7 is an isometric view of the guide housing component of the anti-tip interlocking linkage mechanism of the invention.
Figure 8:
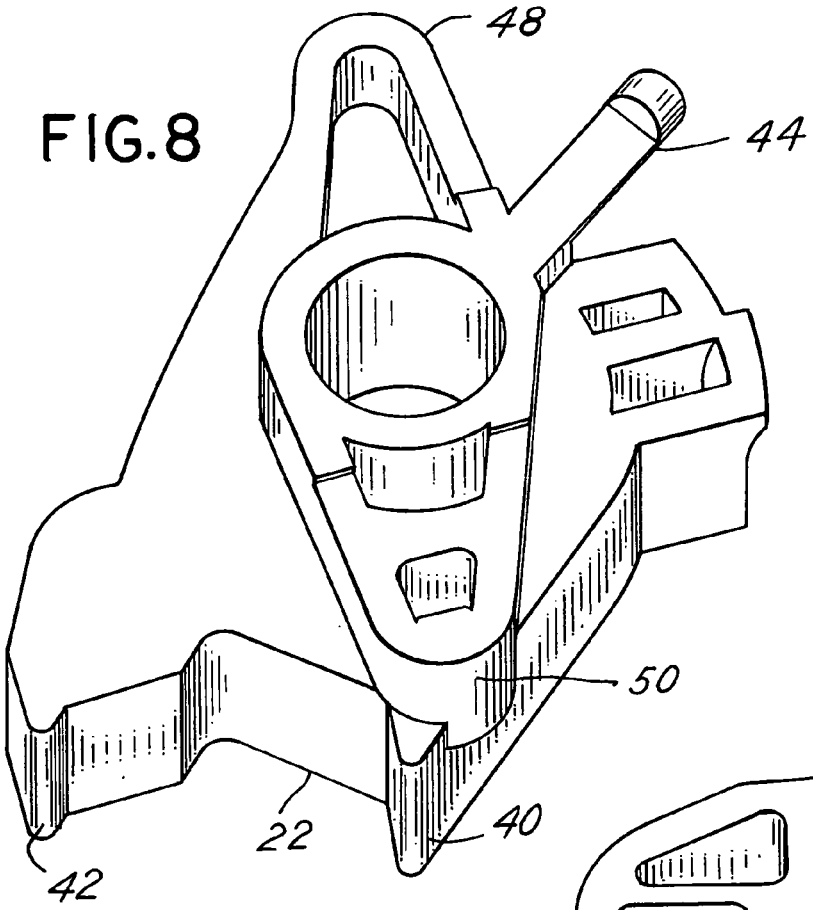
FIG. 8 is an isometric view of the rotatable cam utilized in the anti-tip interlocking linkage mechanism of the invention as viewed from the inside or back side.
Figure 9:
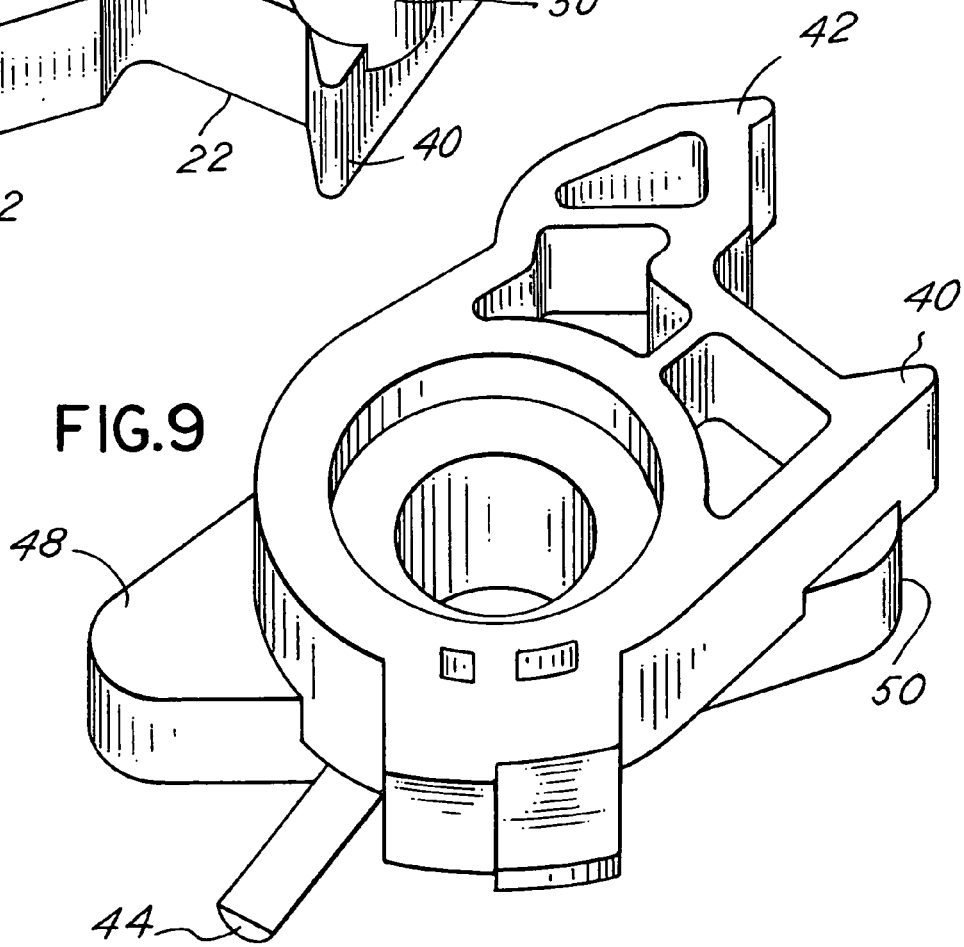
FIG. 9 is an isometric view of the cam of FIG. 8 as viewed from the opposite or front side thereof.

Referring to FIG. 7, there is depicted the guide housing 20. The guide housing 20 includes guide blocks, such as guide blocks 70, 72, 74 and 76 which facilitate guidance of the cam followers 26 and 27. The guide housing 20 also includes molded snap tabs 80 and 82 which cooperate with openings or detents defined in the outside channel 9 of the slide assembly. Thus, the housing 20 may be held in a generally locked position within the guide channel 9. Also, the housing 20 includes a first and a second center slot 21, 23 with detents cooperative respectively with openings or tabs 25, 25A molded in followers 26, 27 to thereby retain the followers 26, 27 in housing 20 after the followers 26, 27 are snap fitted into the housing 20.

Auxiliary Cam Housing Locking Mechanism

FIGS. 13, 15 and 16 depict an auxiliary cam housing locking mechanism. The mechanism cooperates with the guide housing 20 to provide an alternative mechanism for locking or limiting movement of cam followers 26, 27 thereby locking a cabinet 1 in a closed position. Specifically, a cam follower 26 projecting from a guide housing 20 associated with a slide assembly 12 and, more particularly, mounted on the outside channel 9 thereof is cooperatively engaged by an auxiliary cam 90 as shown in FIG. 15 retained within auxiliary housing 92. The housing 92 includes mounting slots 94 and 96 which cooperatively engage with projections 98 and 99 on the top of the guide housing 20. Thus, the housing 92 may be snap fastened to the guide housing 20 as depicted in FIG. 13.

The cam 90 is slidable within the housing 92 and is normally biased by a spring 100 to the extended position so that it does not engage with the top of the stub 56 of follower 26. However, a cable or actuator 102 attached to the cam member 90 may be utilized to pull the cam 90 in the housing 92 laterally in opposition to the force of the biasing spring 100 thereby positioning the active face 104 of the cam against the top of the stud 56. Such movement will preclude any extension of the stud 56 on the follower 26. As a result, follower 26 and all of the followers 26, 27 connected in the line of followers 26, 27 through the connecting rods 30 cannot be moved. Thus, the inside channels 7 will be engaged against second lobes 42 and the cams 22 with the second lobes 42 will not be rotatable. In this manner, the mechanism as depicted in FIG. 13 will lock all of the drawers 5A, 5B, 5C in the closed position.

Actuation of the actuator arm or cable 102 may be effected in the manner depicted, for example, in FIG. 16. There a linkage bar 125 is attached to a locking mechanism 126. The locking mechanism drives or moves the bar 125 against the biasing force of the spring 100 as previously described as the lock mechanism within the lock 126 is rotated, for example, by a key.

The linkage for the cam member 90 may include an elastic connection to the cable 102 thereby enabling closure of an open drawer 5 even though the remaining drawers are locked. Thus a spring 91 may be inserted between cam member 90 and cable 102 to permit some movement of cam member 90 as a drawer 5 is closed.

An alternative channel 7 locking construction is illustrated in FIG. 14. As depicted in FIG. 14, the inside channel 7 may be replaced by a slide channel 110 having a slot 112 in the side thereof. In this embodiment the cam member 22 has been eliminated as are the lobes associated therewith. The cam follower 127 is modified to include a projecting stud 128 which, upon engagement of the auxiliary locking mechanism with the cam follower 26 will provide for movement of the follower 26 to cause the block 128 to engage in the slot 112 thereby locking the channel 110 in position. Thus, the auxiliary locking mechanism of FIG. 13 may be incorporated to provide for locking of a channel 110.

Front Panel Locking Mechanism

A flipper door or rotatable front panel 15 which rotates about an axis, for example, a horizontal axis can also be controlled or provided with a locking feature alone or in combination with the mechanism of the invention. Again, a panel door lock housing 140 of molded polymeric material is snap fitted onto an outside channel 9 of a drawer slide assembly where that outside channel 9 is associated with a drawer or sliding tray positioned beneath the pivotal panel 15. The outside channel 9 is spaced from the side of the cabinet wall as previously described. Thus, the housing 140 may be inserted between the outside channel 9 and the cabinet wall 2. The housing 140 supports a pivot arm 142 pivotal about a pivot connection 144 between a bolt release position and a bolt engagement position. More specifically, the arm 142 includes a forward bolt 146 which is movable upwardly and downwardly, in the direction of the arrow shown in FIG. 17, to be engaged with or released from a strike opening 148 in the side of panel 15. An actuator cable 150 passes through a guide passage 152 defined in the housing 140 and engages the arm 142 to drive the arm upwardly or downwardly in response to movement of the cable or a linkage bar 150. The arm 142 may be biased in either direction toward an open or a closed position. In practice, the arm 142 is biased by an elastomeric cantilever spring arm 154 attached to an extension 156 of the bolt arm 142 toward the strike closed position. However, the biasing direction of the arm 142 may be in either sense.

FIG. 18 illustrates how linkage arms 150 and 102 may be connected to a single locking mechanism 160 attached to a cabinet 1, for example, on the front side of the cabinet 1. Thus, a panel door lock housing 140 as well an auxiliary locking housing 92 are mounted on a single slide assembly 12 on one side 2 of a cabinet 1. A single locking mechanism 160 may then be utilized to operate both of the locking mechanisms associated with the housing 92 and housing 140. FIG. 19 illustrates the manner in which a series of slide assemblies 9 mounted on the side of a cabinet 1 may be interconnected by connecting rods 30 and controlled by an auxiliary cam mechanism in a housing 92. Also a pivotal front panel door 15 may be locked and controlled by means of a locking mechanism in a housing 140 attached to the slide assembly 12.

FIG. 20 illustrates an alternative interconnection mechanism between a lock assembly 160 and various locking mechanisms such as the auxiliary cam housing 92 locking mechanism and/or a front panel lock housing 140 using cables 170 and 172 to effect the connection rather than more rigid linkage arms. It will be noted that the lock assembly 160 includes a central plug 161 which rotates a mechanism to effect simultaneous operation of the cables 170 and 172.

Figure 21:
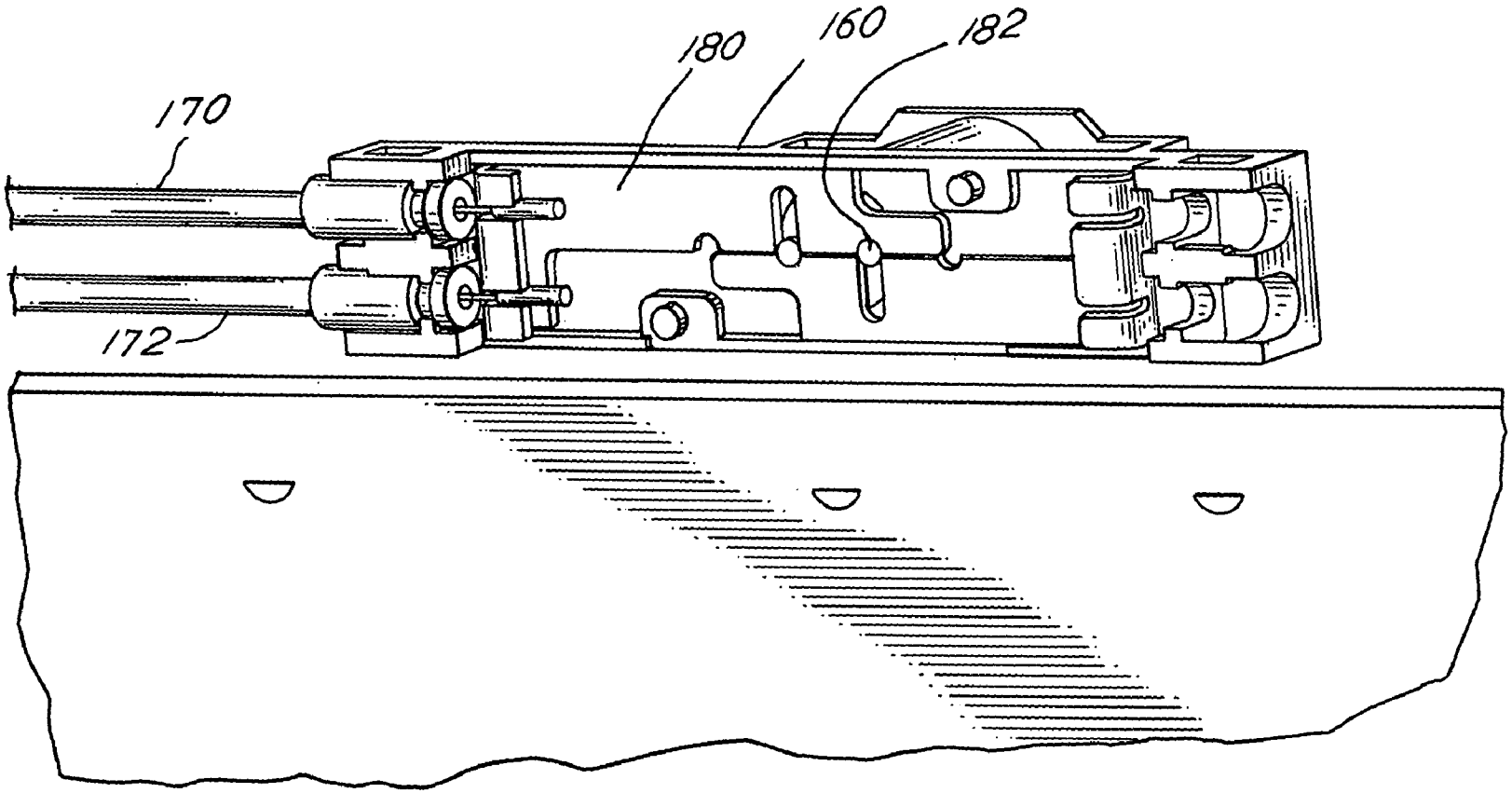
FIG. 21 depicts in an isometric view a locking assembly of the type that is utilized in combination with the linkage mechanism of FIG. 20.
Figure 22:
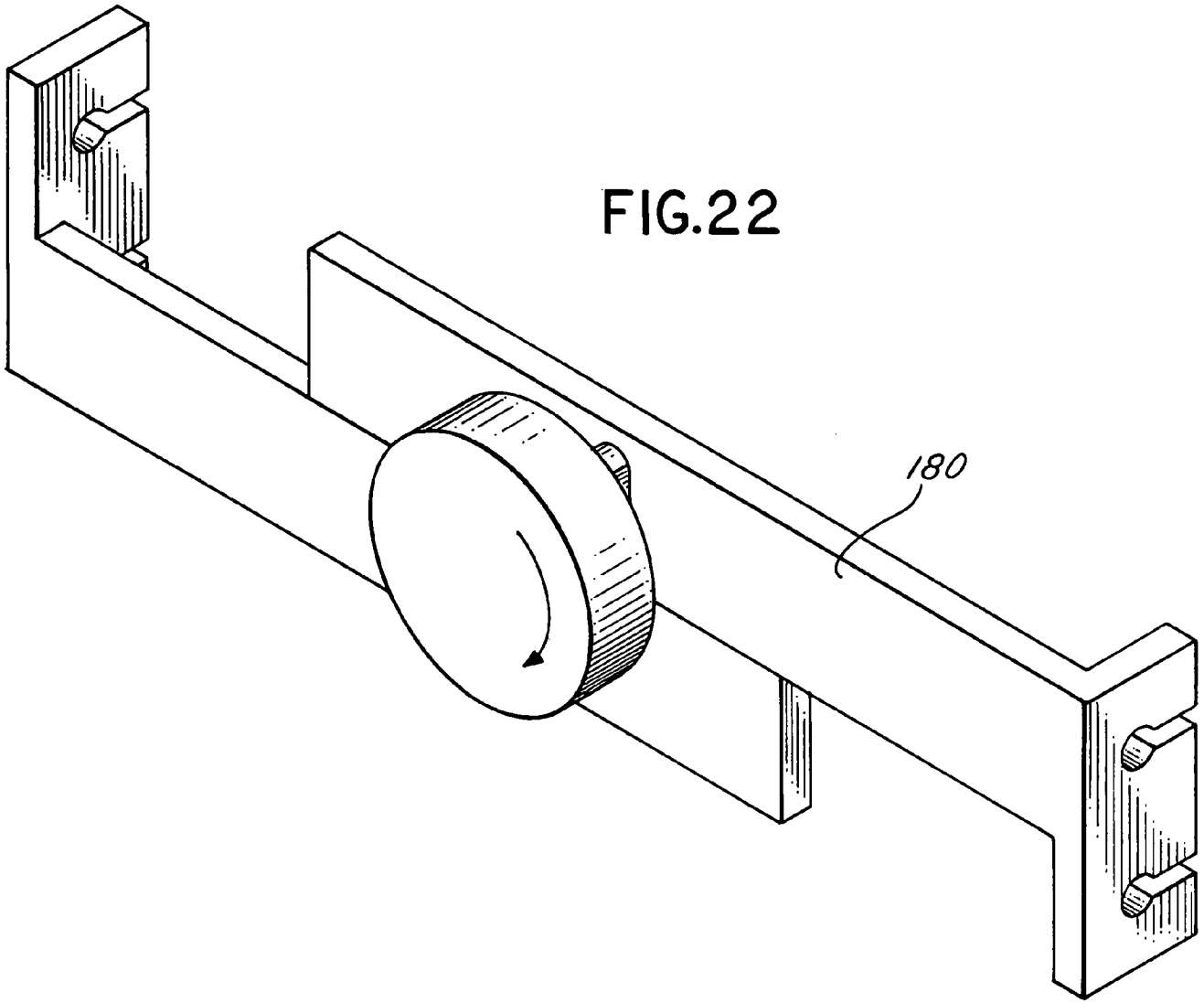
FIG. 22 depicts a first alternative lock control incorporated in a locking assembly of the type depicted in FIG. 21.
Figure 23:
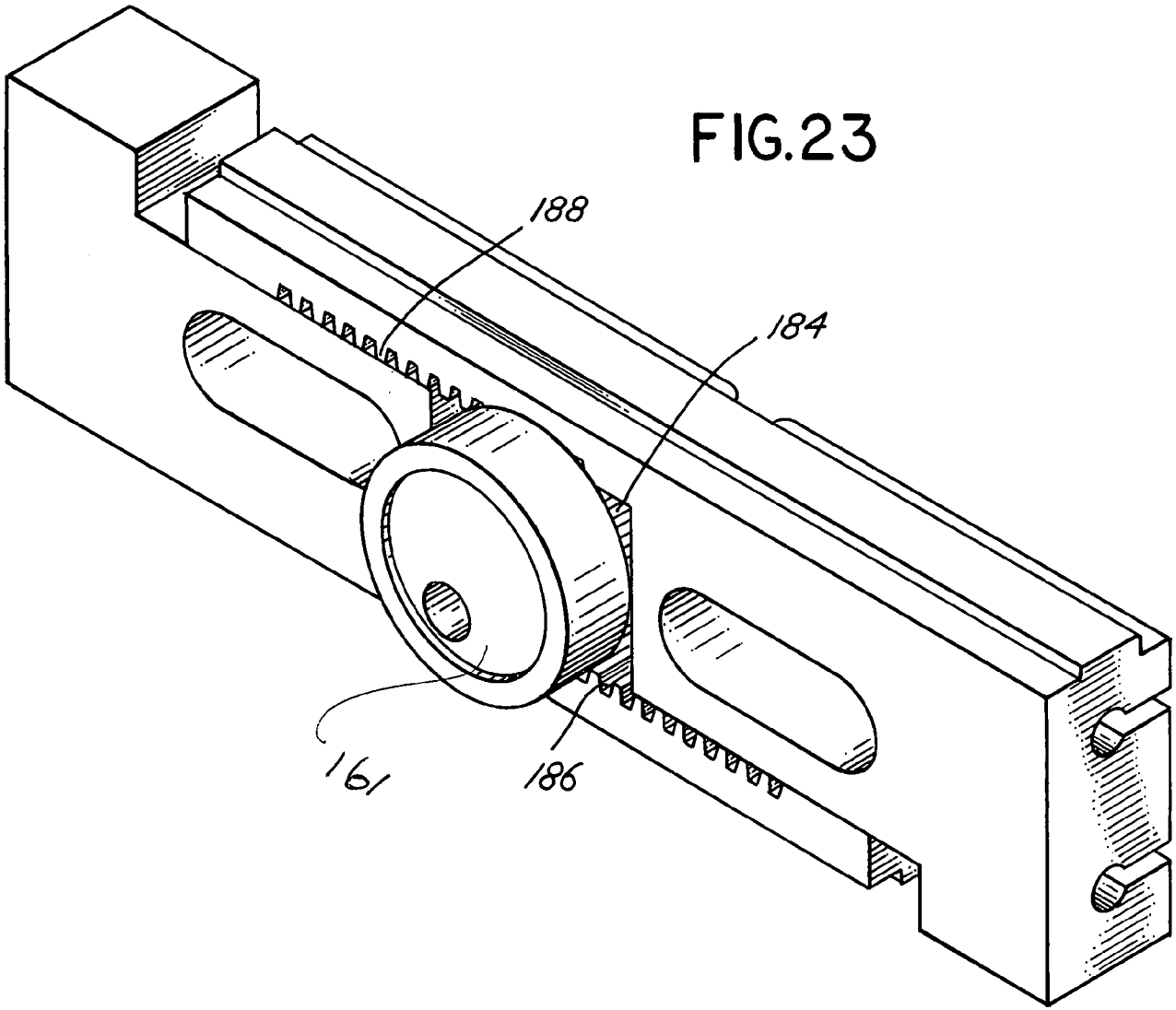
FIG. 23 illustrates an alternative locking mechanism for the locking assembly of FIG. 21.
Figure 24:
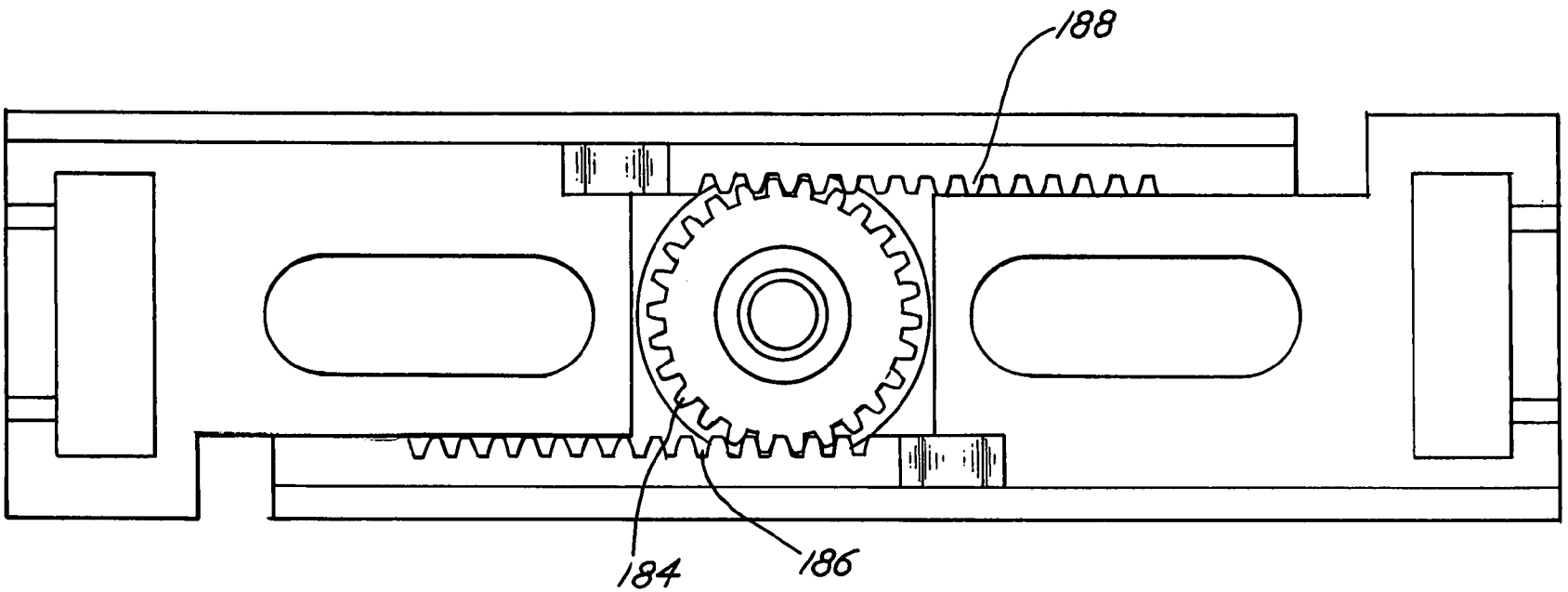
FIG. 24 is a plan view of the locking assembly or locking mechanism of FIG. 23.

FIGS. 21–23 illustrate various alternative lock assembly constructions which may be utilized to effect control of one, two or more cables or linkage bars. A lock assembly may include a plate 180 which is transversely driven by a rotatable eccentric cam mechanism 182 driven by a plug 161 of a lock. Both cables and/or linkage bars 170 and 172 are attached to the translatable plate 180 and move simultaneously in response to the linear movement of the plate 160 as the eccentric cam mechanism 182 is rotated. FIG. 22 illustrates the manner of construction of such a cam mechanism. FIG. 23 illustrates an alternative mechanism wherein a rack and pinion is utilized in place of an eccentric cam mechanism. In other words, a pinion 184 is associated with a rotatable plug 161 to drive opposed racks 186 and 188 and thereby effect linear movement of cables or linkage bars attached thereto. The locking mechanism may thus be positioned on the front of a cabinet, for example, as depicted in FIG. 20. As discussed, both cable and linkage bar mechanisms may be utilized.

Various other alternative constructions may be incorporated in combination or as part of the described invention. The interaction of the stub or stud 56 with the extruded connecting rods 30 may be provided in a wide variety of forms. Other structural details of the invention may be altered without departing from the spirit and scope of the invention. The invention is therefore limited only by the following claims and equivalents thereof.

What is claimed is:

1. A mechanism for interlocking at least two vertically adjacent slide mounted items in a cabinet between the side walls of said cabinet, said items selected from the group consisting of drawers, panels, pivotally mounted panels and fixtures, said mechanism comprising, in combination:

a pair of telescoping slides for mounting each item for slidable movement between a retracted position and an extended position, at least one of each pair of slides including a) an inside channel attachable to a slide mounted item, and an outside channel attachable to a side of the cabinet adjacent said slide mounted item, said inside channel including an inner end, an upper edge, a generally parallel lower edge, and a tab adjacent to the inner end; and b) said outside channel slidably receiving the inside channel along a slidable pathway and said inside channel moveable between an inside channel retracted position and an inside channel extended position, said outside channel further including an inner end which underlies, at least in part, the inner end of the inside channel in the inside channel retracted position;

a guide housing mounted on the inner end of the outside channel in opposed relation to the inside channel, said guide housing including a vertical guideway, and said vertical guideway including a pivot axis also located in the slidable pathway;

a rotatable cam member pivotally mounted in the guide housing; for rotational movement about the pivot axis, said cam member including at least a first peripheral lobe and a second peripheral lobe, at least one of said first and second lobes engageable by the inner end of the inside channel upon movement thereof to the inside channel retracted position and also to the inside channel extended position, said cam member further including a third peripheral lobe and a fourth peripheral lobe, said third and fourth lobes projecting radially in opposite directions from the pivot axis and said cam member rotatable to a position aligning said third and fourth lobes to be transverse in direction to the movement of the inside channel when the inside channel is slidably moved to the extended position;

at least one cam follower slidably mounted in the guide housing guideway movable transversely to the direction of movement of the inside channel upon cooperative engagement of said cam follower by the third or fourth peripheral lobe of the cam member upon rotation of the cam member effected by movement of the inside channel toward the inside channel extended position, said cam follower including a projecting stud for receipt of a removable rod, said stud extending transverse to inside channel movement;

a connecting rod having a cross sectional configuration congruent with the the stud and connectable between the stud and a next vertically adjacent slide; and a cooperative tab and slot interconnecting the cam follower and guide housing to limit travel of the cam follower relative to the guide housing.

2. The mechanism of claim 1 including first and second cam followers mounted in opposed relationship in the guide housing for movement in opposite directions in response to engagement with the rotatable cam member, each cam follower comprising a substantially identical construction, each cam follower including an outer end and an inner end, each inner end including at least one leg projecting transversely therefrom, said legs aligned with each other for engagement to limit movement of the cam followers into the guide housing when the inside channel is moved to the inside channel retracted position.

3. A mechanism for interlocking at least two vertically adjacent slide mounted items in a cabinet between the side walls of said cabinet, said items selected from the group consisting of drawers, panels, pivotally mounted panels and fixtures, said mechanism comprising, in combination:

a pair of telescoping slides for mounting each slide mounted item for slidable movement between a retracted position and an extended position, at least one of each pair of slides including a) an inside channel for attachment to a slide mounted item, and an outside channel for attachment to a side of a cabinet adjacent said slide mounted item, said inside channel including an inner end, an upper edge, a generally parallel lower edge and a projecting tab adjacent to the inner end; and b) said outside channel slidably receiving the inside channel along a slidable pathway and said inside channel moveable between an inside channel retracted position and an inside channel extended position, said outside channel further including an inner end which underlies, at least in part, the inner end of the inside channel in the inside channel retracted position;

a guide housing mounted on the inner end of the outside channel in opposed relation to the inside channel, said guide housing including a vertical guideway, and said vertical guideway including a pivot axis also located in the slidable pathway;

a rotatable cam member pivotally mounted in the guide housing for rotational movement about vertical guideway pivot axis, said cam member including at least a first peripheral lobe for engagement by the inner end of the inside channel upon movement thereof to the inside channel retracted position, or the inside channel extended position; a third peripheral lobe which projects generally radially from the pivot axis generally transverse in direction to the movement of the inside channel when the inside channel is in the inside channel extended position and a fourth peripheral lobe which projects generally radially in the opposite direction from the third lobe;

at least two cam followers slidably mounted in the guide housing guideway for cooperative engagement by the third and fourth peripheral lobes, respectively, upon rotation of the cam member by movement of the inside channel toward the inside channel extended position, said cam followers including a projecting stud, said stud extending generally transverse to inside channel movement;

a connecting rod having a cross sectional shape generally congruent with the cross section of the stud and connectable between the stud and a next vertically adjacent slide;

said cam followers each being substantially identical and each including a leg extending toward the other in alignment to limit transverse movement toward each other upon movement of the inside channel to the inside channel retracted position; and a cooperative tab and slot interconnecting the cam follower and guide housing to limit travel of the cam follower relative to the guide housing.

* * * * *